US008867966B2

(12) United States Patent
Acosta et al.

(10) Patent No.: US 8,867,966 B2
(45) Date of Patent: Oct. 21, 2014

(54) TONER CARTRIDGE FOR USE IN AN IMAGE FORMING DEVICE

(75) Inventors: Benjer Albaran Acosta, Sarangani Province (PH); Mark William Amann, Lexington, KY (US); James Anthany Carter, II, Lexington, KY (US); Gary Neal Hackney, Georgetown, KY (US); Katrina Rosit Lactuan, Cebu (PH); James Richard Leemhuis, Lexington, KY (US); Benjamin Keith Newman, Lexington, KY (US); Matthew Lee Rogers, Lexington, KY (US); Rodney Evan Sproul, Lexington, KY (US); Jason Hale, Richmond, KY (US); Harald Portig, Versailles, KY (US); Keith Seaman, Lexington, KY (US); Bryan Christopher Scharf, Richmond, KY (US); Christopher Gene Vowels, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 279 days.

(21) Appl. No.: 13/340,935

(22) Filed: Dec. 30, 2011

(65) Prior Publication Data

US 2013/0170868 A1 Jul. 4, 2013

(51) Int. Cl.
*G03G 15/08* (2006.01)

(52) U.S. Cl.
USPC ..... 399/258; 399/262; 399/263

(58) Field of Classification Search
USPC ..... 399/103, 106, 258, 262–263
See application file for complete search history.

(56) References Cited

U.S. PATENT DOCUMENTS

| | | | |
|---|---|---|---|
| 4,824,388 | A | 4/1989 | Pickel |
| 4,839,691 | A | 6/1989 | Tagawa et al. |
| 4,891,017 | A | 1/1990 | Kuhn et al. |
| 5,002,497 | A | 3/1991 | Plocek et al. |
| 5,083,158 | A | 1/1992 | Kashima et al. |
| 5,259,779 | A | 11/1993 | Ooya et al. |

(Continued)

FOREIGN PATENT DOCUMENTS

JP 2000-356895 A 12/2000

OTHER PUBLICATIONS

Co-pending U.S. Appl. Nos. 13/340,876, 13/340,881, 13/340,884, and 13/340,911, filed Dec. 30, 2011.

(Continued)

*Primary Examiner* — David Bolduc
(74) *Attorney, Agent, or Firm* — Justin M Tromp; John Victor Pezdek

(57) ABSTRACT

A toner cartridge according to one example embodiment includes a housing that defines a reservoir for containing toner. An exit port in fluid communication with the reservoir faces downward on the front of the housing near a first side. A shutter positioned at the exit port is movable between an open position and a closed position. A toner delivery system for transferring toner from the reservoir includes a main interface gear exposed on the front of the housing near the top of the second side. A rearward facing opening is positioned near the first side of the housing for receiving a first engagement feature in an image forming device for opening and closing the shutter. A forward facing slot is positioned near the first side of the housing for receiving a second engagement feature in the image forming device for locking and unlocking the shutter.

26 Claims, 22 Drawing Sheets

(56) References Cited

U.S. PATENT DOCUMENTS

| | | | | |
|---|---|---|---|---|
| 5,392,371 | A | 2/1995 | Morlion et al. | |
| 5,490,802 | A | 2/1996 | Plyler et al. | |
| 5,587,777 | A | 12/1996 | Miyaji et al. | |
| 5,605,150 | A | 2/1997 | Radons et al. | |
| 5,608,501 | A | 3/1997 | Makino | |
| 5,746,617 | A | 5/1998 | Porter, Jr. et al. | |
| 5,758,233 | A | 5/1998 | Coffey et al. | |
| 5,768,661 | A | 6/1998 | Coffey et al. | |
| 5,848,342 | A | 12/1998 | Tanda | |
| 5,946,531 | A | 8/1999 | Miura et al. | |
| 5,997,329 | A | 12/1999 | Kosmala | |
| 6,014,533 | A | 1/2000 | Kawana | |
| 6,014,536 | A * | 1/2000 | Ban et al. | 399/258 |
| 6,097,908 | A | 8/2000 | Uchiyama et al. | |
| 6,128,453 | A | 10/2000 | Ban et al. | |
| 6,168,262 | B1 | 1/2001 | Clark et al. | |
| 6,186,809 | B1 | 2/2001 | Kung | |
| 6,254,408 | B1 | 7/2001 | Hattori et al. | |
| 6,259,874 | B1 | 7/2001 | Murakami et al. | |
| 6,266,505 | B1 | 7/2001 | Ban et al. | |
| 6,349,182 | B2 | 2/2002 | Otsubo et al. | |
| 6,386,899 | B1 | 5/2002 | Ushio et al. | |
| 6,502,917 | B1 | 1/2003 | Shinada et al. | |
| 6,582,039 | B2 | 6/2003 | Johnson et al. | |
| 6,594,458 | B2 | 7/2003 | Ban et al. | |
| 6,652,309 | B2 | 11/2003 | Sukagawa | |
| 6,771,922 | B2 | 8/2004 | Blanck et al. | |
| 6,773,283 | B2 | 8/2004 | Yoshimatsu et al. | |
| 6,782,219 | B2 | 8/2004 | Yoshino et al. | |
| 6,786,750 | B2 | 9/2004 | Itoh | |
| 6,792,228 | B2 | 9/2004 | Ban et al. | |
| 6,848,925 | B2 | 2/2005 | Nishide | |
| 6,853,828 | B2 | 2/2005 | Ban et al. | |
| 6,968,139 | B2 | 11/2005 | Ban et al. | |
| 6,978,101 | B2 | 12/2005 | Ban et al. | |
| 7,074,084 | B2 | 7/2006 | Shuey et al. | |
| 7,086,872 | B2 | 8/2006 | Myer et al. | |
| 7,258,558 | B1 | 8/2007 | Dawson et al. | |
| 7,272,336 | B1 | 9/2007 | Dawson et al. | |
| 7,386,250 | B2 | 6/2008 | Ban et al. | |
| 7,548,710 | B2 | 6/2009 | Gayne et al. | |
| 7,606,520 | B2 | 10/2009 | Dawson | |
| 8,165,505 | B2 | 4/2012 | Kojima | |
| 2002/0025725 | A1 | 2/2002 | Ushio et al. | |
| 2002/0057319 | A1 | 5/2002 | Saruta et al. | |
| 2003/0035016 | A1 | 2/2003 | Tanaka | |
| 2003/0223775 | A1 * | 12/2003 | Yoshino et al. | 399/119 |
| 2005/0135838 | A1 | 6/2005 | Miller | |
| 2005/0169672 | A1 | 8/2005 | Ban et al. | |
| 2006/0067725 | A1 * | 3/2006 | Miyabe et al. | 399/90 |
| 2006/0103701 | A1 | 5/2006 | Chan | |
| 2006/0140664 | A1 | 6/2006 | Takami | |
| 2006/0171744 | A1 | 8/2006 | Ikeda et al. | |
| 2007/0003325 | A1 | 1/2007 | Jung et al. | |
| 2007/0212118 | A1 | 9/2007 | Nagae et al. | |
| 2007/0223965 | A1 | 9/2007 | Takagi | |
| 2007/0230999 | A1 | 10/2007 | Shimomura | |
| 2008/0101821 | A1 | 5/2008 | Gayne et al. | |
| 2009/0142103 | A1 | 6/2009 | Chaudhuri et al. | |
| 2010/0221039 | A1 * | 9/2010 | Kawai et al. | 399/121 |

OTHER PUBLICATIONS

International Search Report and Written Opinion of the International Searching Authority dated Feb. 1, 2013 for PCT Application No. PCT/US12/65148 (7 pages).

International Search Report and Written Opinion of the International Searching Authority dated Jan. 31, 2013 for PCT Application No. PCT/US12/65149 (7 pages).

International Search Report and Written Opinion of the International Searching Authority dated Jan. 31, 2013 for PCT Application No. PCT/US12/65152 (6 pages).

International Search Report and Written Opinion of the International Searching Authority dated Jan. 28, 2013 for PCT Application No. PCT/US12/65147 (12 pages).

Copending U.S. Appl. Nos. 13/780,060 and 13/780,042, filed Feb. 28, 2013 and U.S. Appl. No. 13/845,406, filed Mar. 18, 2013.

Prosecution history for copending U.S. Appl. No. 13/340,797 including Non-Final Office Action dated Jun. 7, 2013.

Prosecution history for copending U.S. Appl. No. 13/723,888 including Non-Final Office Action dated Jun. 6, 2013.

Prosecution history for copending U.S. Appl. No. 13/340,881 including Notice of Allowance dated Aug. 6, 2013.

Prosecution history of U.S. Appl. No. 13/340,911 including Non-Final Office Action dated Dec. 31, 2013.

Prosecution history of U.S. Appl. No. 13/780,060 including Non-Final Office Action dated Dec. 23, 2013.

Prosecution history of U.S. Appl. No. 13/340,797 including Notice of Allowance dated Oct. 9, 2013.

Prosecution history of U.S. Appl. No. 13/723,888 including Notice of Allowance dated Feb. 26, 2014.

International Search Report and Written Opinion of the International Searching Authority dated Nov. 15, 2013 for PCT Application No. PCT/US2013/046464.

Prosecution history of U.S. Appl. No. 13/532,186 including Non-Final Office Action dated Sep. 30, 2013, Final Office Action dated Feb. 24, 2014 and Non-Final Office Action dated Apr. 23, 2014.

Prosecution history of U.S. Appl. No. 13/532,397 including Non-Final Office Action dated Feb. 26, 2014 and Notice of Allowance dated Jun. 10, 2014.

Prosecution history of U.S. Appl. No. 13/340,876 including Non-Final Office Action dated Nov. 27, 2013.

U.S. Appl. No. 13/780,042, filed Feb. 28, 2013.

Prosecution history of U.S. Appl. No. 13/340,884 including Notice of Allowance dated Oct. 22, 2013.

Public use/sale statements dated Jul. 14, 2014 regarding toner bottles for Sharp MX-C402SC, and Lexmark E320 and E322 printers.

Prosecution history of U.S. Appl. No. 13/340,911 including Notice of Allowance dated Jun. 25, 2014.

Prosecution history of U.S. Appl. No. 13/532,397 including Notice of Allowance dated Sep. 2, 2014.

* cited by examiner

TONER CARTRIDGE FOR USE IN AN IMAGE FORMING DEVICE

CROSS REFERENCES TO RELATED APPLICATIONS

This patent application is related to U.S. patent application Ser. No. 13/340,911, filed Dec. 30, 2011, entitled "Toner Cartridge Having Positional Control Features", U.S. patent application Ser. No. 13/340,876, filed Dec. 30, 2011, entitled "Toner Cartridge having a Shutter Lock Mechanism", U.S. patent application Ser. No. 13/340,881, filed Dec. 30, 2011, entitled "Toner Cartridge having a Shutter Lock Mechanism", and U.S. patent application Ser. No. 13/340,884, filed Dec. 30, 2011, entitled "Toner Cartridge having a Shutter Lock Mechanism", all of which are assigned to the assignee of the present application.

BACKGROUND

1. Field of the Disclosure

The present disclosure relates to a toner cartridge for use in an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges. As a result, in systems utilizing a separate toner cartridge and imaging unit, the toner cartridge is often referred to as a "toner bottle" even though the toner cartridge is more complex than a mere bottle for holding toner.

To deliver toner from the toner cartridge to the imaging unit, an auger in the toner cartridge may be used to feed toner from an exit port on the toner cartridge into an entrance port on the imaging unit and into a second auger that disperses the toner within the imaging unit. As the toner is drawn out of the toner cartridge, it is augured through a shutter used for sealing the exit port of the toner cartridge when it is not inserted in the printer. In order to prevent the undesired release of toner, the shutter preferably remains closed unless the toner cartridge is installed in the image forming device. Accordingly, the shutter may be biased toward the closed position. As the toner cartridge reaches its final position in the image forming device, a pin or other type of projection on the image forming device may engage a catch on the toner cartridge and supply an opposing force to open the shutter. For example, U.S. Pat. No. 7,606,520, entitled "Shutter for a Toner Cartridge for use with an Image Forming Device" and assigned to the assignee of the present invention provides an example shutter mechanism.

A problem may be experienced if a user accidentally releases toner from the cartridge by inadvertently actuating the shutter or by intentionally engaging the shutter catch without appreciating its purpose until it is too late. The released toner may fall from the toner cartridge and contact an area surrounding the image forming device or a user's clothing resulting in uncleanliness. Image forming devices having a separate toner cartridge and imaging unit present an additional concern. If the imaging unit is not present when the toner cartridge is installed in the image forming device and the cartridge's shutter is opened by the image forming device, any toner exiting the shutter will leak from the cartridge's exit port into the interior of the image forming device because the imaging unit is not there to receive it. When leaked toner falls into the internal portions of the image forming device, it can cause reliability issues and, in some cases, print defects. Accordingly, it will be appreciated that a mechanism that prevents the unwanted release of toner from the cartridge's shutter is desired.

Further, in devices utilizing a separate toner cartridge and imaging unit, it is important that the toner cartridge and imaging unit are precisely aligned relative to one another within the image forming device. For example, if the exit port on the toner cartridge is misaligned with the entrance port on the imaging unit, severe toner leakage may occur. The toner cartridge and imaging unit must also be rigidly held in place after they are installed in the image forming device in order to prevent their positional alignment from being disturbed during operation. The requirement for tight positional control must be balanced with the need to permit the user to easily load and unload the imaging unit and the toner cartridge into and out of the image forming device. Accordingly, it will be appreciated that a toner cartridge having positional control features that permit precise alignment of the cartridge while permitting various angles of insertion of the cartridge into the image forming device is also desired.

SUMMARY

A toner cartridge for use in an image forming device according to one example embodiment includes a housing having a top, a bottom, a front, and a rear positioned between a first side and a second side of the housing. The housing defines a reservoir for containing toner therein. An exit port is in fluid communication with the reservoir and faces downward on the front of the housing near the first side. A shutter is positioned at the exit port that is movable between an open position to permit toner to pass out of the exit port and a closed position to prevent toner from passing out of the exit port. A toner delivery system for transferring toner from the reservoir out of the exit port includes a main interface gear for providing rotational power to the toner delivery system. A portion of the main interface gear is exposed on the front of the housing near the top of the second side and engagable with a corresponding drive gear in the image forming device. A rearward facing opening is positioned near the first side of the housing for receiving a first engagement feature in the image forming device for opening and closing the shutter. A forward facing slot is positioned near the first side of the housing for receiving a second engagement feature in the image forming device for locking and unlocking the shutter.

A toner cartridge for use in an image forming device having an imaging unit separate from the toner cartridge removably installed therein according to another example embodiment includes a housing having a top, a bottom, a front, and a rear positioned between a first side and a second side of the housing. The housing defines a reservoir for containing toner therein. An exit port is in fluid communication with the reservoir and faces downward on the front of the housing near the first side. A shutter is positioned at the exit port that is movable between an open position to permit toner to pass out of the exit port and a closed position to prevent toner from passing out of the exit port. A toner delivery system for transferring toner from the reservoir out of the exit port includes a main interface gear for providing rotational power to the toner delivery system. A portion of the main interface gear is exposed on the front of the housing near the top of the second side and engagable with a corresponding drive gear in the image forming device. A linkage is operatively connected to the shutter to open the shutter upon being actuated by an engagement feature on the image forming device. A rearward facing opening is positioned near the first side of the housing for receiving the engagement feature on the image forming device. An interlock is operatively engaged with the linkage and biased toward a locked position preventing the linkage from opening the shutter. The interlock is movable to an unlocked position upon being actuated by an engagement feature on the imaging unit that permits the linkage to open the shutter. A forward facing slot is positioned near the first side of the housing for receiving the engagement feature on the imaging unit.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
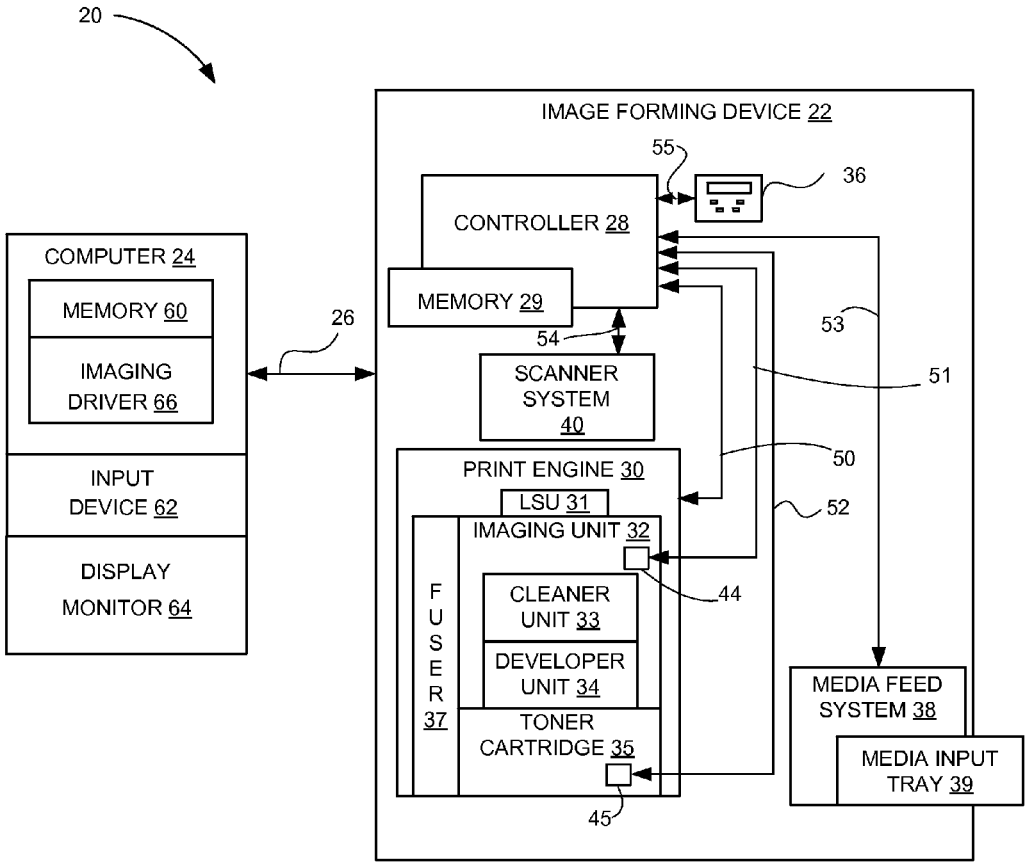
FIG. 1 is a block diagram of an imaging system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 is removably mounted in image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
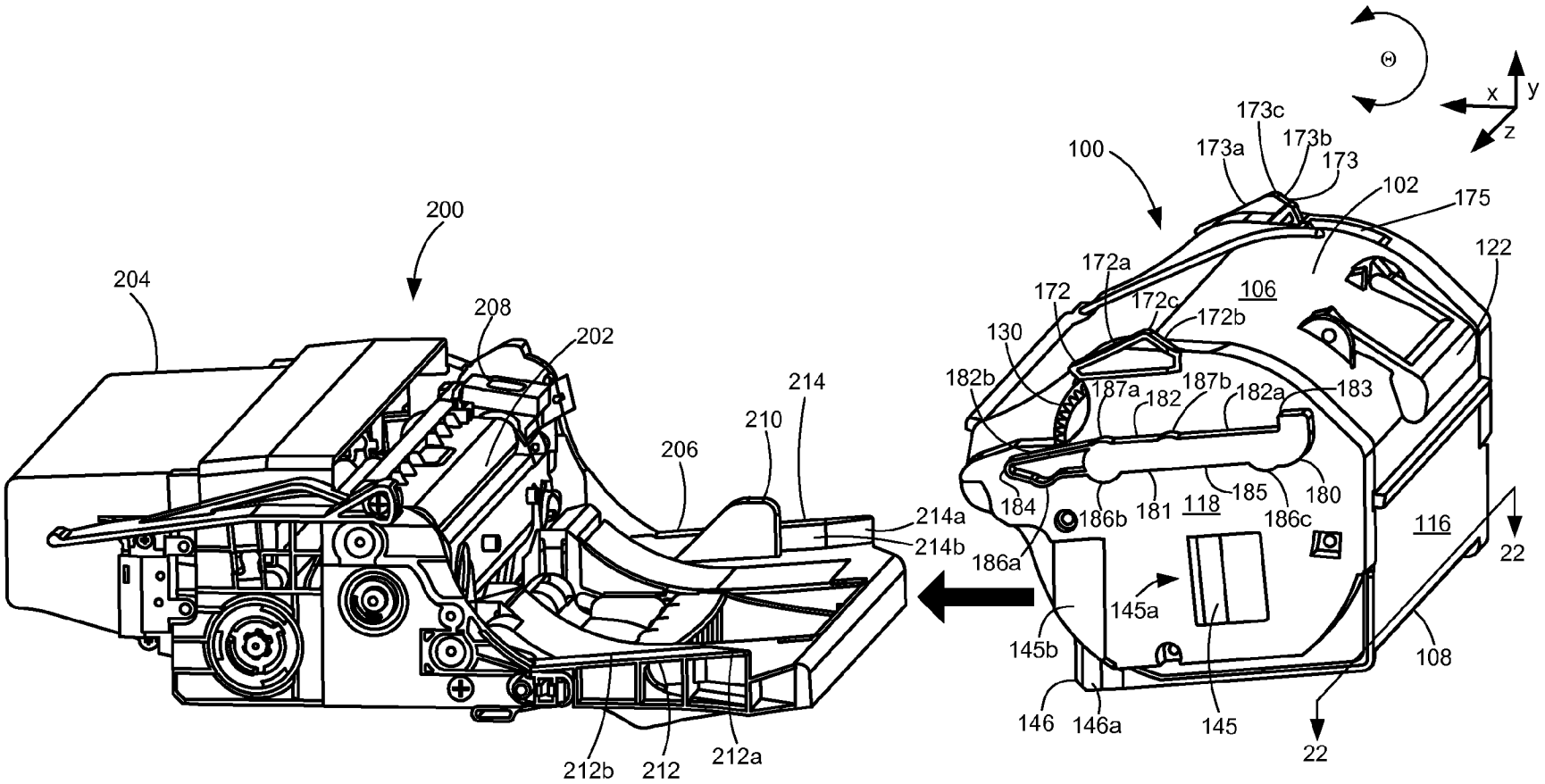
FIG. 2 is a perspective view of a toner cartridge and an imaging unit according to one example embodiment.

Referring now to FIG. 2, a toner cartridge 100 and an imaging unit 200 are shown according to one example embodiment. Imaging unit 200 includes a developer unit 202 and a cleaner unit 204 mounted on a common frame 206. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow shown in FIG. 2. This arrangement allows toner cartridge 100 to be removed and reinserted easily when replacing an empty toner cartridge without having to remove imaging unit 200. Imaging unit 200 may also be readily removed as desired in order to maintain, repair or replace the components associated with developer unit 202, cleaning unit 204 or frame 206 or to clear a media jam.

With reference to FIGS. 2-5, toner cartridge 100 includes a housing 102 having an enclosed reservoir 104 (FIG. 5) for holding a quantity of toner therein. Housing 102 may be viewed as having a top or lid 106 mounted on a base 108. Base 108 includes first and second side walls 110, 112 connected to adjoining front and rear walls 114, 116. In one embodiment, top 106 is ultrasonically welded to base 108 thereby forming enclosed reservoir 104. First and second end caps 118, 120 are mounted to side walls 110, 112, respectively. First and second end caps 118, 120 may be snap fitted into place or attached by screws or other fasteners. A handle 122 may be provided on top 106 or base 108 of toner cartridge 100 to assist with insertion and removal of toner cartridge 100 from imaging unit 200 and image forming device 22. As shown in FIG. 6, a fill port 124 is provided on side wall 112 that is used to fill toner cartridge 100 with toner. After filling, fill port 124 is closed by a plug 126 and/or cap 128.

Figure 5:
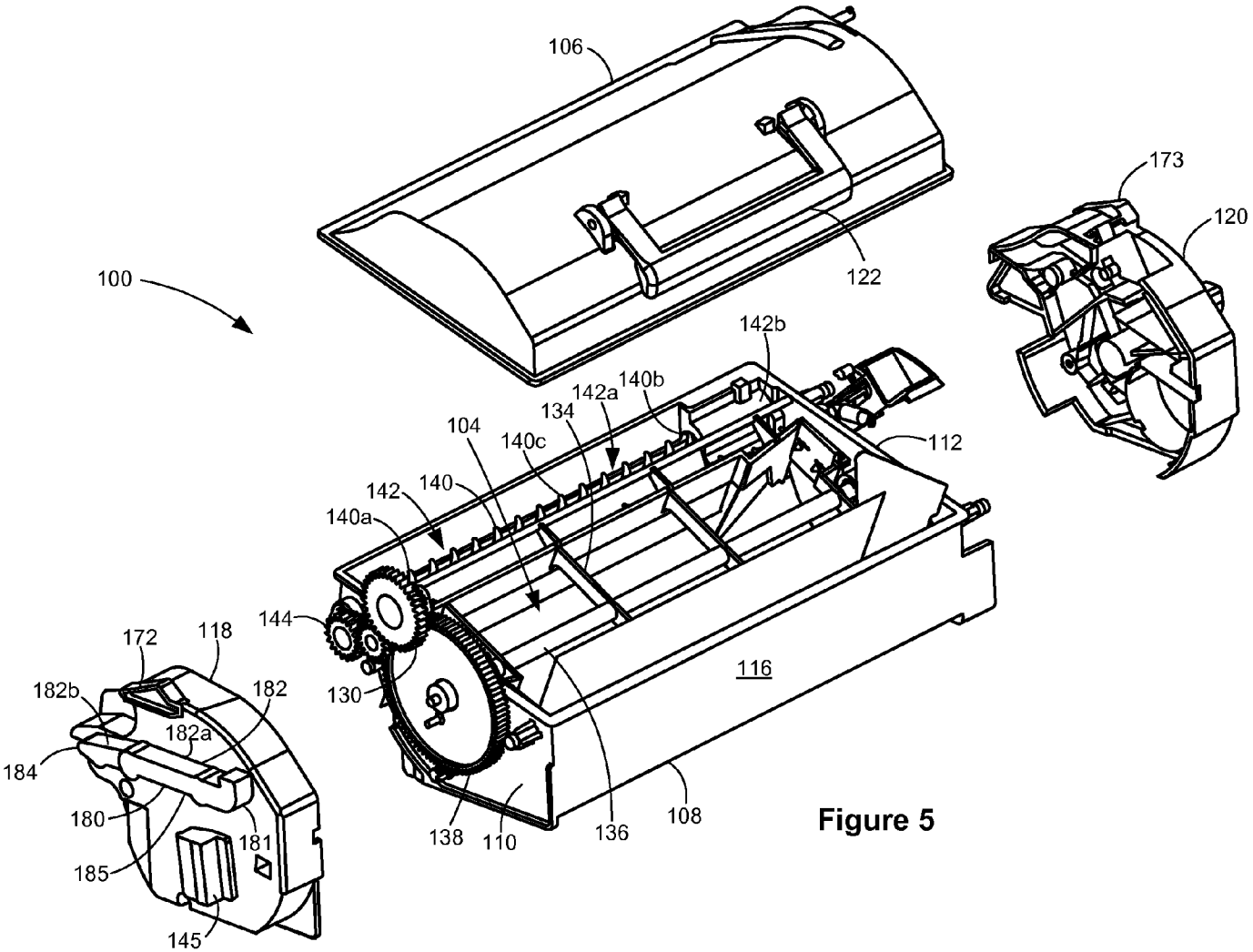
FIGS. 5 and 6 are exploded views of the toner cartridge shown in FIG. 2 showing a reservoir for holding toner therein.
Figure 6:
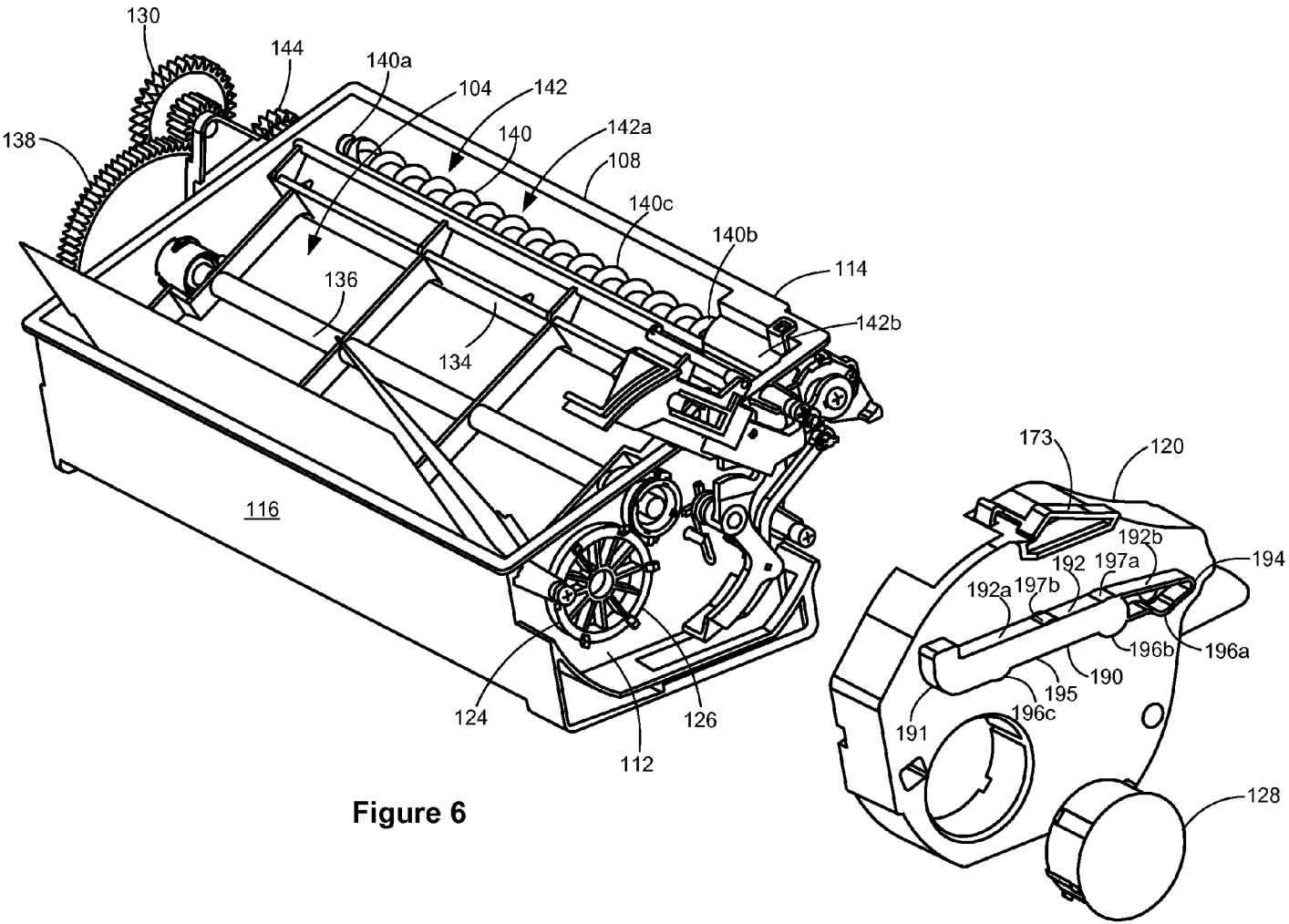

With reference to FIG. 5, various drive gears are housed within a space formed between end cap 118 and side wall 110. A main interface gear 130 engages with a drive system in image forming device 22 that provides torque to main interface gear 130. A portion of main interface gear 130 is exposed between side wall 110 and end cap 118 on a front portion of toner cartridge 100 (FIG. 2). As discussed in greater detail below, various linkages are housed within a space formed between end cap 120 and side wall 112. One or more paddles 134 are rotatably mounted within toner reservoir 104 with first and second ends of a drive shaft 136 of paddle(s) 134 extending through aligned openings in side walls 110, 112, respectively. The axis of drive shaft 136 is positioned below and spaced rearward from the axis of main interface gear 130. A drive gear 138 is provided on the first end of drive shaft 136 that engages with main interface gear 130 either directly or via one or more intermediate gears. Bushings may be provided on each end of drive shaft 136 where it passes through side walls 110, 112. Accordingly, side wall 110 may also be termed the "drive" or "driven" side of toner cartridge 100.

With reference to FIGS. 5 and 6, an auger 140 having first and second ends 140*a*, 140*b*, and a spiral screw flight 140*c* is positioned in a channel 142 extending along the width of front wall 114 between side walls 110, 112. Channel 142 and the axis of auger 140 are positioned above the axis of drive shaft 136 but below the axis of main interface gear 130. Channel 142 and the axis of auger 140 are also spaced forward from the axes of drive shaft 136 and main interface gear 130. Channel 142 may be integrally molded as part of front wall 114 or formed as a separate component that is attached to front wall 114. Channel 142 is generally horizontal in orientation along with toner cartridge 100 when toner cartridge 100 is installed in image forming device 22. First end 140*a* of auger 140 extends through side wall 110 and a drive gear 144 is provided on first end 140*a* that engages with main interface gear 130 either directly or via one or more intermediate gears. Channel 142 includes an open portion 142*a* and an enclosed portion 142*b*. Open portion 142*a* is open to toner reservoir 104 and extends from side wall 110 toward second end 140*b* of auger 140. Enclosed portion 142*b* of channel 142 extends from side wall 112 and encloses a shutter assembly 150 (FIG. 7) and second end 140*b* of auger 140. As paddle(s) 134 rotate, they deliver toner from toner reservoir 104 into open portion 142*a* of channel 142. Auger 140 is rotated via drive gear 144 to deliver toner received in channel 142 to shutter assembly 150. Shutter assembly 150 regulates whether toner is permitted to exit toner cartridge 100 through an exit port 152 provided in front wall 114 and shown in FIG. 7. Exit port 152 is disposed at the bottom of channel 142 facing downward so that gravity will assist in exiting toner through exit port 152.

Shutter assembly 150 is shown in more detail in FIGS. 8A, 8B, 9A and 9B. Shutter assembly 150 includes a shutter 154 that is rotatable between a closed position shown in FIGS. 8A and 9A and an open position shown in FIGS. 8B and 9B. Shutter 154 includes an open end 154*a* that receives second end 140*b* of auger 140 therein. As auger 140 rotates, it delivers toner from channel 142 to shutter 154. Shutter 154 includes a radial opening 154*b* that is connected to open end 154*a* by an internal channel in shutter 154. Radial opening 154*b* permits toner to exit toner cartridge 100 through exit port 152 as discussed in greater detail below.

Figure 7:
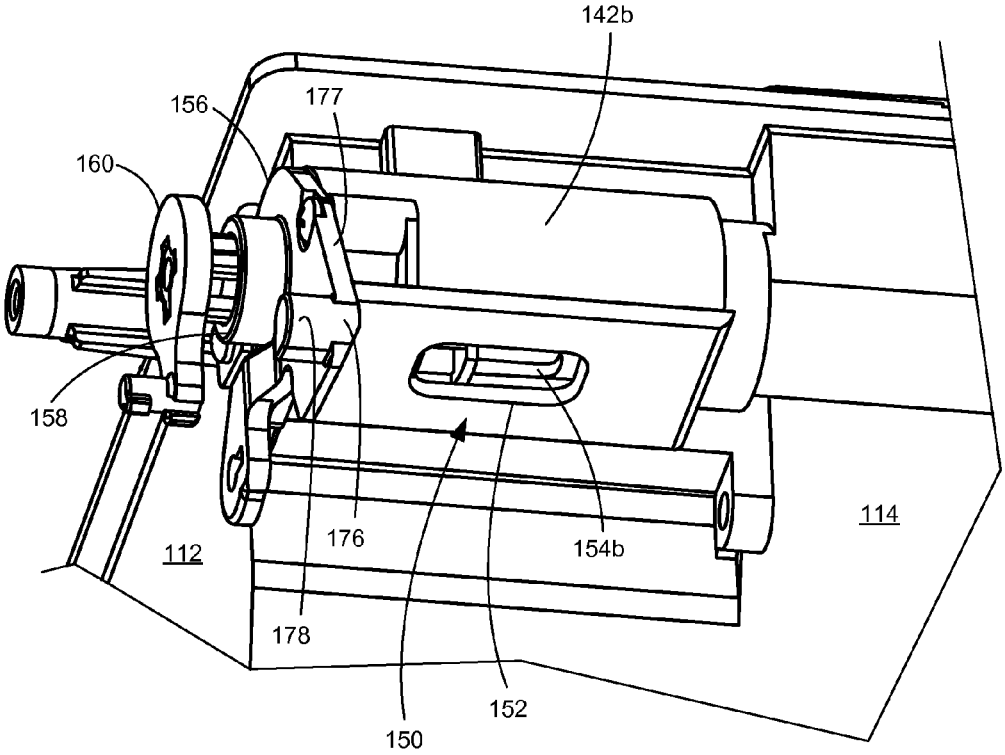
FIG. 7 is a perspective view of a front portion of the toner cartridge shown in FIG. 2 showing an exit port thereof.

A retaining member 156 is mounted on side wall 112 of toner cartridge 100 (FIG. 7). In the example embodiment illustrated, retaining member 156 is a separate component attached to housing 102; however, retaining member 156 may also be integrally molded as part of housing 102. Retaining member 156 includes a bushing 158 that receives a closed end 154*c* of shutter 154. Closed end 154*c* of shutter 154 is connected to a lever 160 that opens and closes shutter 154. In the example embodiment illustrated, closed end 154*c* of shutter 154 includes a key 162 and lever 160 includes a corresponding keyway 164. Key 162 and keyway 164 couple shutter 154 to lever 160 such that the rotation of lever 160 opens and closes shutter 154. It will be appreciated that this configuration may be reversed so that lever 160 includes a key and closed end 154*c* includes a corresponding keyway. In the embodiment illustrated, lever 160 is connected to closed end 154*c* via a fastener 166 that passes through keyway 164 and a threaded hole 168 in closed end 154*c*; however, lever 160 and shutter 154 may be connected by any suitable means such as by being snap fit together. A post 170 is provided on the distal end of lever 160.

Figure 8A:
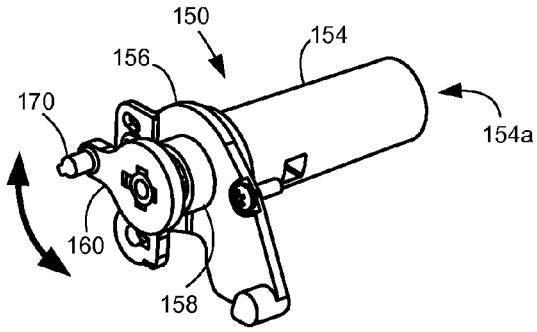
FIGS. 8A and 8B are perspective views of a shutter assembly for use with the toner cartridge in a closed position and an open position, respectively, according to one example embodiment.
Figure 8B:
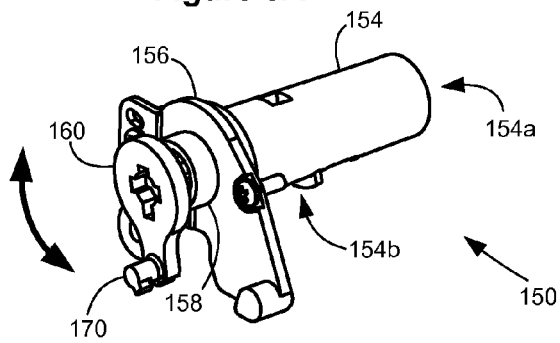
Figure 9A:
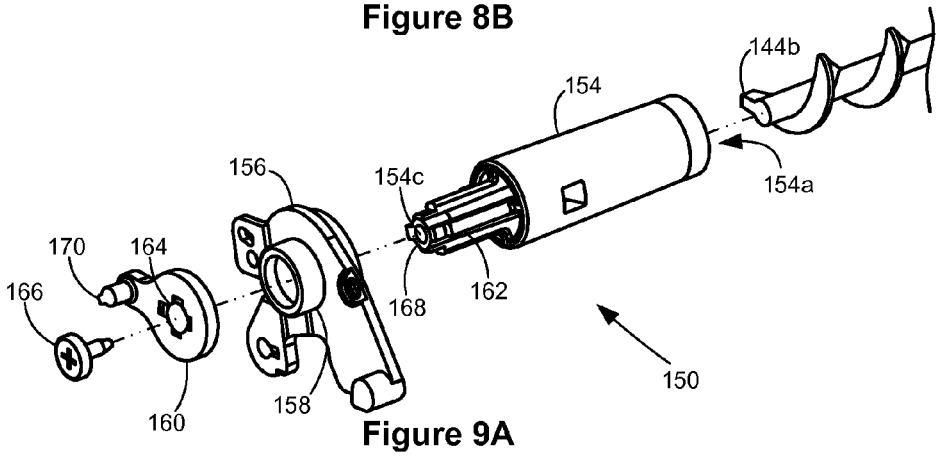
FIGS. 9A and 9B are exploded views of the shutter assembly shown in FIGS. 8A and 8B.
Figure 9B:
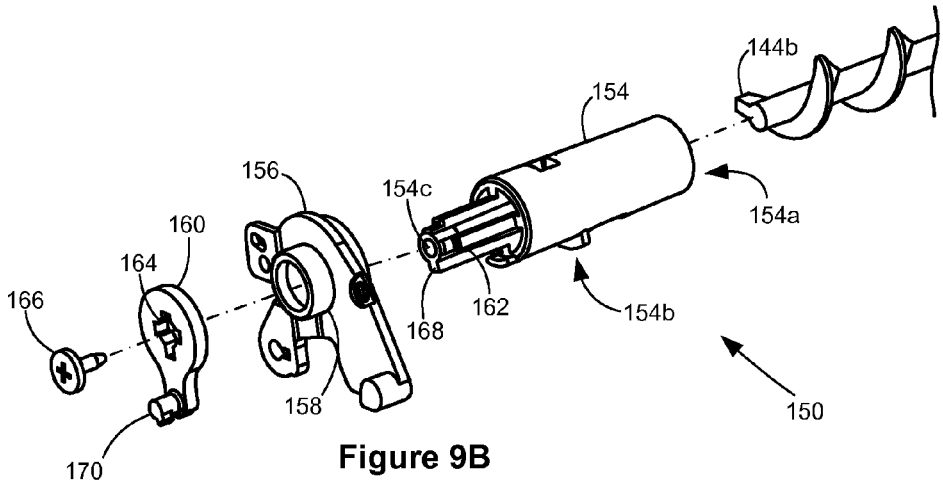

When lever 160 is in a first position shown in FIGS. 8A and 9A, shutter 154 is in a closed position with radial opening 154*b* positioned against an internal surface of enclosed portion 142*b* of channel 142 in order to prevent toner from exiting toner cartridge 100. When lever 160 rotates to a second position shown in FIGS. 8B and 9B, shutter 154 rotates to an open position where radial opening 154*b* is aligned with exit port 152 to permit toner to exit toner cartridge 100. When shutter 154 is in the open position, toner may be delivered from reservoir 104 of toner cartridge 100 to imaging unit 200 by rotating paddle(s) 134 and auger 140 as desired. Specifically, as paddle(s) 134 rotate, they deliver toner from toner reservoir 104 into open portion 142*a* of channel 142. As auger 140 rotates, it delivers toner received in channel 142 to shutter 154 through open end 154*a*. Toner passes through the internal channel in shutter 154 and out of radial opening 154*b* and exit port 152 into a corresponding entrance port 208 in developer unit 202 (FIG. 2).

Figure 10:
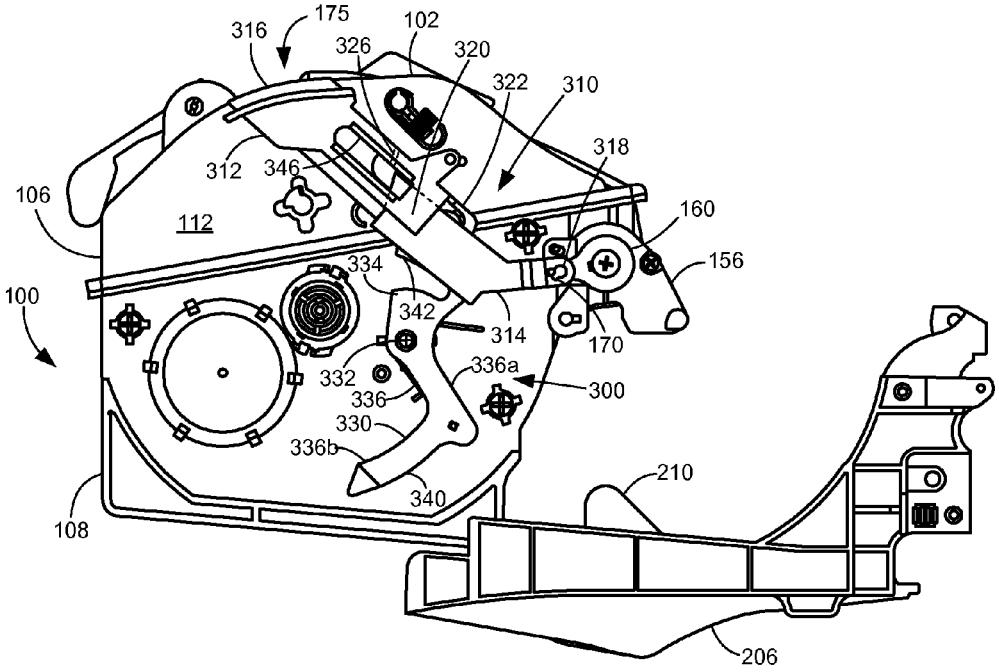
FIG. 10 is a side elevation view of the toner cartridge shown in FIG. 2 with an end cap removed to show a shutter lock mechanism in a locked position with a shutter closed according to a first example embodiment.

FIG. 10 shows a side view of cartridge 100 with end cap 120 removed to more clearly illustrate an example shutter lock mechanism 300 housed between side wall 112 and end cap 120. Shutter lock mechanism 300 includes a shutter linkage 310 that actuates lever 160 to open and close shutter 154 and an interlock 330 that prevents shutter 154 from opening unless toner cartridge 100 is installed within image forming device 22 and mated with imaging unit 200. In this embodiment, shutter linkage 310 includes an outer linkage 312 and an inner linkage 314. Outer linkage 312, in one form, is forked having outer and inner side walls 320, 322, respectively, and includes an engagement surface 316, such as a button-like area, that is exposed through a rearward facing opening 175 in an exterior portion of housing 102 (see also FIGS. 2-4), such as a rear portion of end cap 120 next to lid 106 as shown. Inner linkage 314 is connected at one end to lever 160. In the example embodiment illustrated, inner linkage includes a channel 318 that receives post 170 extending from lever 160. However, inner linkage 314 and lever 160 may be connected by any suitable means such as, for example, by reversing the post/channel configuration such that inner linkage 314 includes a post and lever 160 includes a corresponding channel. Inner linkage 314 is pivotable about post 170 of lever 160. Outer linkage 312 and inner linkage 314 are elongated members that overlap with one another. In the embodiment illustrated, inner linkage 314 is positioned in the fork between side walls 320, 322 of outer linkage 312; however, this configuration may be reversed as desired. Outer linkage 312 is biased by a suitable biasing member such as a spring (e.g., an extension spring) toward opening 175 where engagement surface 316 is exposed. Similarly, inner linkage 314 is biased by a biasing member away from lever 160 so that shutter 154 is biased toward the closed position.

Figure 3:
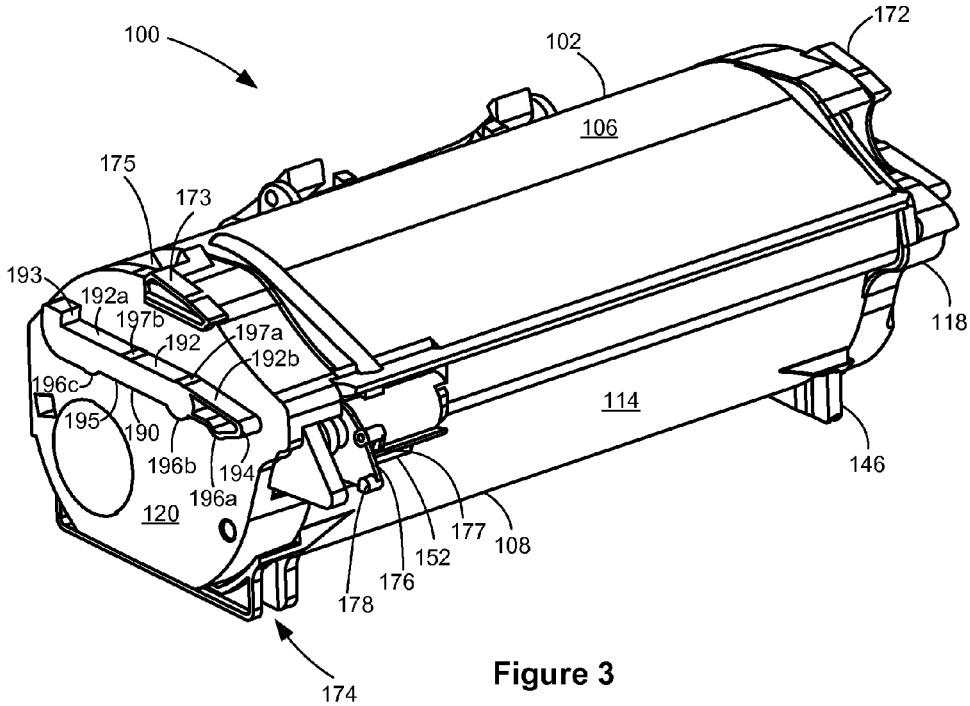
FIGS. 3 and 4 are additional perspective views of the toner cartridge shown in FIG. 2.

In this embodiment, interlock 330 is pivotally attached to side wall 112 at its axis of rotation 332. Interlock 330 includes a first leg 334 and a second leg 336 that each extend radially from axis 332. Second leg 336 includes a first portion 336*a* that extends radially from axis 332 and a second portion 336*b* that extends in a curved manner near the distal end of first portion 336*a* at an angle that is roughly perpendicular to first portion 336*a*. Second portion 336*b* of second leg 336 includes an engagement surface 340 that contacts an engagement feature, such as a fin 210 on frame 206 (or another engagement feature on imaging unit 200) to permit shutter 154 to open. As shown in FIG. 3, a forward facing slot 174 is provided in a front portion of base 108 and/or end cap 120 of toner cartridge 100 to receive fin 210. Slot 174 limits the access to interlock 330 to reduce the likelihood that a user will inadvertently unlock interlock 330. With reference back to FIG. 10, first leg 334 includes a flexible member 342 at a distal end thereof. Flexible member 342 includes a curved engagement surface 344 (FIG. 11) on an outer surface thereof facing inner linkage 314. A bottom surface of inner linkage 314 (hidden behind the side wall of inner linkage 314) is supported by flexible member 342 on engagement surface 344. Interlock 330 is biased by one or more biasing members in the locked position shown in FIG. 10 to prevent shutter 154 from opening prior to installation of toner cartridge 100 in image forming device 22 as discussed in greater detail below.

Figure 11:
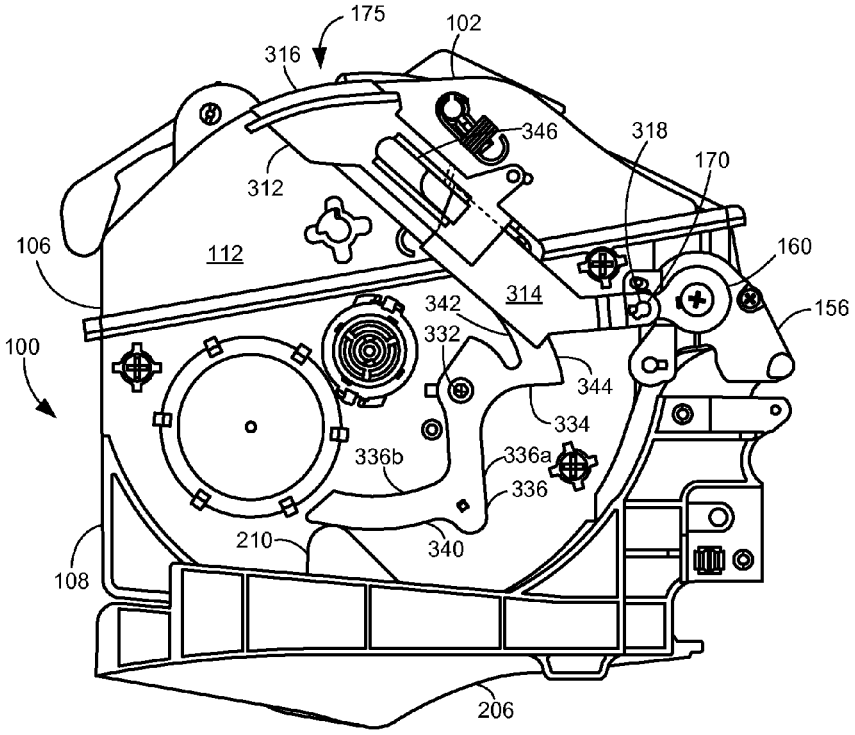
FIG. 11 is a side elevation view of the toner cartridge shown in FIG. 10 showing the shutter lock mechanism in an unlocked position with the shutter closed.
Figure 12:
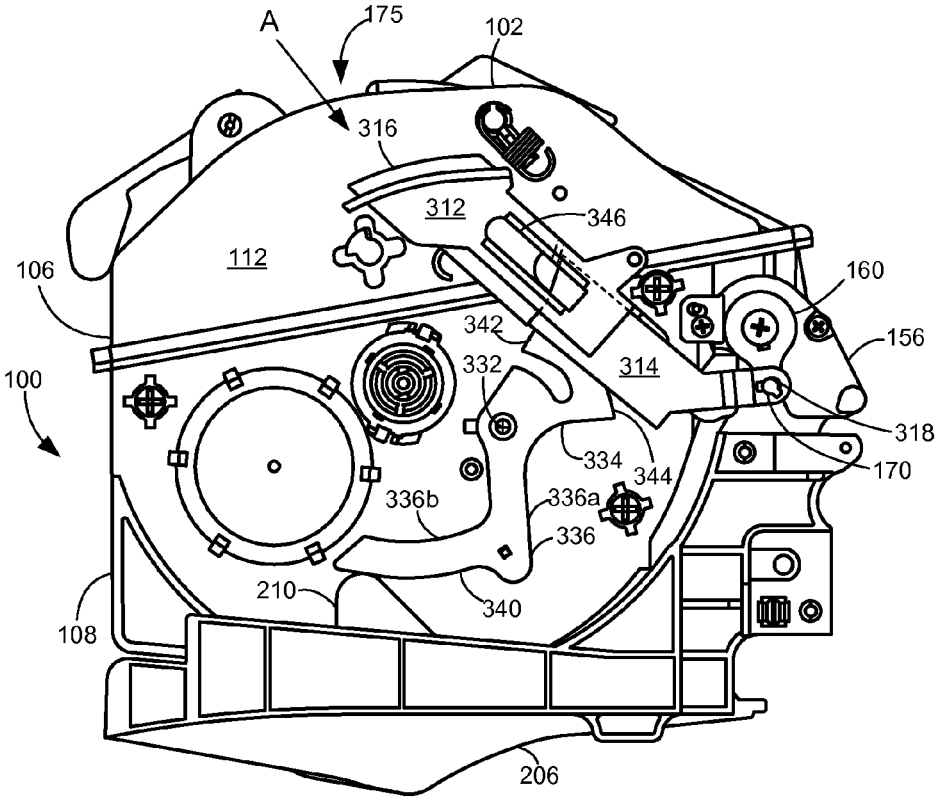
FIG. 12 is a side elevation view of the toner cartridge shown in FIGS. 10 and 11 showing the shutter lock mechanism in the unlocked position with the shutter opened.
Figure 13:
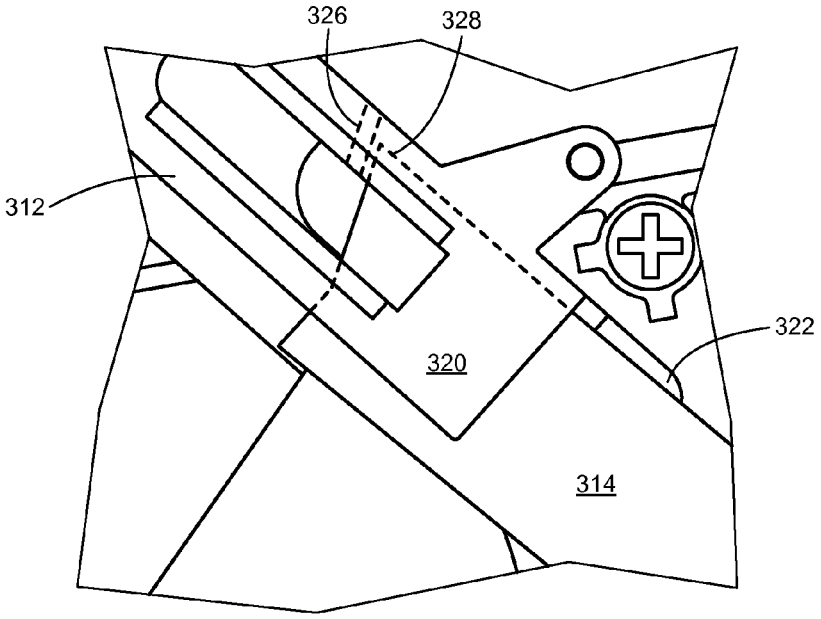
FIG. 13 is a close up view of the toner cartridge shown in FIGS. 10-12 when the shutter lock mechanism is in the unlocked position showing the inner linkage in the path of the catch on the outer linkage to permit the inner linkage to open the shutter when the outer linkage is depressed.

With reference to FIG. 11, when toner cartridge 100 is inserted into image forming device 22 and mated with imaging unit 200, fin 210 enters slot 174 and contacts engagement surface 340 of interlock 330. The force from fin 210 on interlock 330 overcomes the biasing force applied to interlock 330 and causes it to rotate in a clockwise direction (as viewed in FIG. 11) to the unlocked position, in turn, raising inner linkage 314. After toner cartridge 100 is inserted into image forming device 22, when an access door to image forming device 22 is closed, a plunger or other projection extending from an inner surface of the access door (or otherwise linked to the access door) presses engagement surface 316 overcoming the biasing force applied to outer linkage 312 and depressing both outer linkage 312 and inner linkage 314 causing lever 160 to rotate to open shutter 154 as shown in FIG. 12. When engagement surface 316 is pressed, outer linkage 312 translates in the direction shown by the arrow A in FIG. 12. Outer linkage 312 includes an elongated slot 346 that receives a corresponding post on end cap 120 or side wall 112. Slot 346 defines the path of movement of outer linkage 312. As shown in closer detail in FIG. 13, when interlock 330 is in the unlocked position, rotated by fin 210, inner linkage 314 is raised into the path of a catch 326 on the inner top surface of outer linkage 312. As a result, when outer linkage 312 is depressed, catch 326 engages a top corner 328 of inner linkage 314 overcoming the bias applied to inner linkage 314 and causing inner linkage 314 to advance with outer linkage 312 which, in turn, opens shutter 154. When outer linkage 312 and inner linkage 314 are depressed, the motion of inner linkage 314 is not strictly translative; rather, inner linkage 314 dips downward and then rises slightly as lever 160 rotates about the axis of rotation of shutter 154. Flexible member 342 accommodates this down-and-up motion by flexing slightly to allow inner linkage 314 to dip without binding or restring its motion. This helps keep outer linkage 312 and inner linkage 314 engaged with each other.

When toner cartridge 100 is removed from image forming device 22, this sequence is reversed. When the access door to image forming device 22 is opened, outer linkage 312 and inner linkage 314 retract to their biased positions, closing shutter 154. As the user removes toner cartridge 100 from the device, fin 210 disengages from engagement surface 340 causing interlock 330 to rotate in a counter-clockwise direction (as viewed in FIGS. 10-12) to the locked position. As interlock 330 rotates, inner linkage 314 lowers until top corner 328 is below the path of catch 326.

Figure 14:
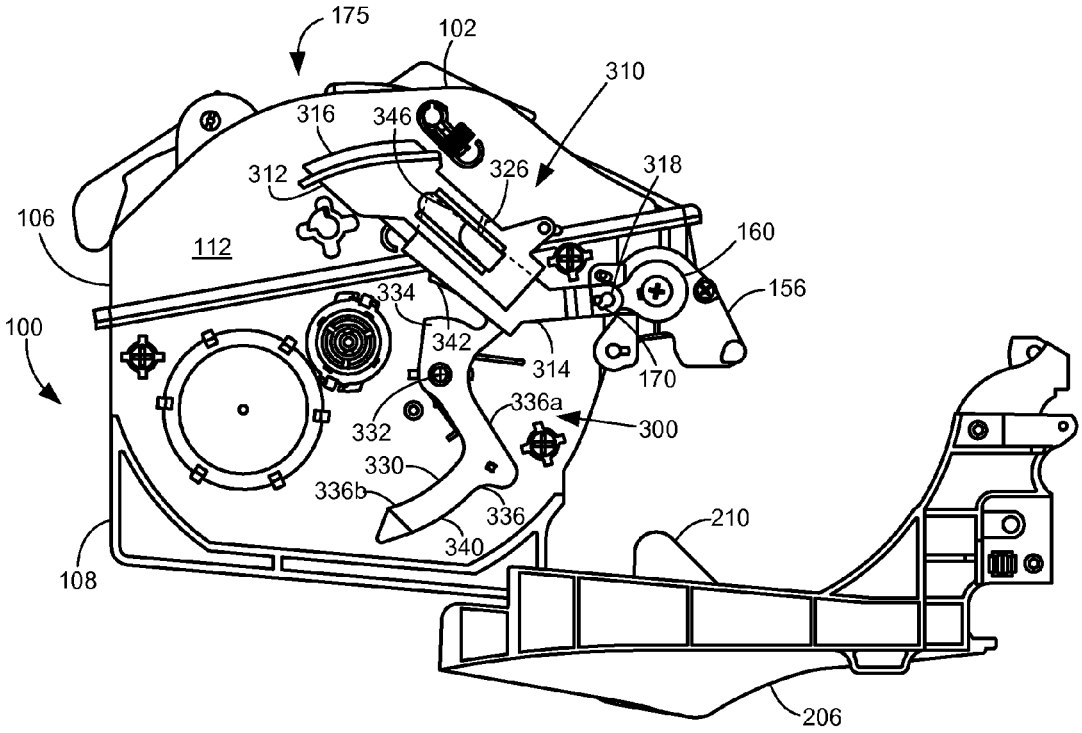
FIG. 14 is a side elevation view of the toner cartridge shown in FIGS. 10-13 showing the shutter lock mechanism in the locked position permitting an outer linkage to be depressed without opening the shutter.
Figure 15:
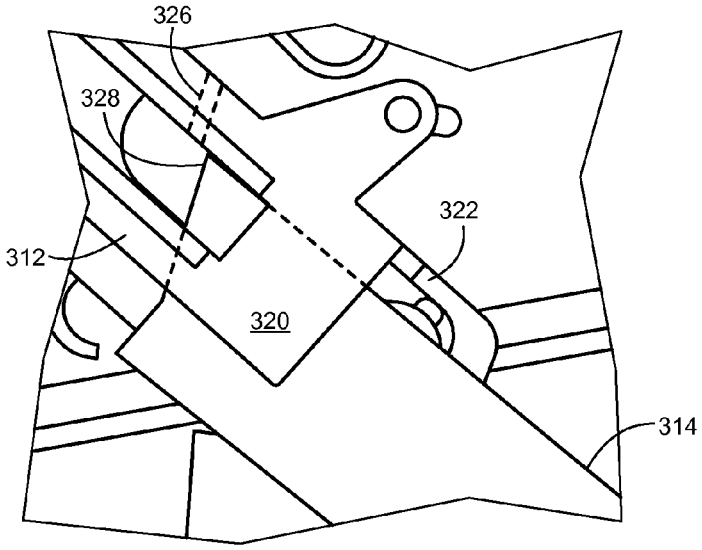
FIG. 15 is a close up view of the toner cartridge shown in FIGS. 10-14 when the shutter lock mechanism is in the locked position showing an inner linkage spaced below a catch on the outer linkage to permit the outer linkage to be depressed without opening the shutter.

With reference to FIG. 14, if engagement surface 316 is pressed while interlock 330 is in the locked position shown in FIGS. 10 and 14, outer linkage 312 is depressed toward and past inner linkage 314. As shown in closer detail in FIG. 15, when interlock 330 is locked, inner linkage 314 is spaced below catch 326 on the inner top surface of outer linkage 312. As a result, outer linkage 312 is free to pass inner linkage 314 without depressing it and, therefore, without opening shutter 154. In this manner, shutter lock mechanism 300 prevents shutter 154 from being opened unless engagement surface 316 of outer linkage 312 is depressed and engagement surface 340 of interlock 330 is engaged. This prevents shutter 154 from opening unless toner cartridge 100 is mated with imaging unit 200 in its final position in image forming device 22. As a result, shutter 154 will remain closed while toner cartridge 100 is removed from image forming device 22 even if engagement surface 316 is pressed.

If shutter 154 was opened without imaging unit 200 present, toner would be able to escape toner cartridge 100 through exit port 152 into the internal area of image forming device 22 potentially causing print defects. Shutter lock mechanism 300 prevents this from occurring. Shutter lock mechanism 300 also allows the user to close the access door to image forming device 22 without opening shutter 154 even if imaging unit 200 is not present. If outer linkage 312 was not free to pass inner linkage 314 when imaging unit 200 is not present, if a user tried to close the access door to image forming device 22, he or she would be unable to because interlock 330 would prevent outer linkage 312 and inner linkage 314 from moving. If the user persisted in trying to close the access door, depending on the force applied, it is possible that one or more of the components making up locking mechanism 300 or another portion of toner cartridge 100 or image forming device 22 could break. Lock mechanism 300 addresses this problem by permitting outer linkage 312 to travel past inner linkage 314 when interlock 330 is in the locked position. Lock mechanism 300 also reduces the likelihood that a user will accidentally release toner from toner cartridge 100 because it requires both engagement surface 316 and engagement surface 340 to be pressed in order to open shutter 154.

With reference to FIGS. 3 and 7, toner cartridge 100 includes a rib or projection 176 projecting from front 114 of housing 102 spaced from exit port 152 near side wall 112. In the example embodiment illustrated, projection 176 is formed as part of retaining member 156. Projection 176 is positioned to actuate a shutter 209 (FIG. 16) that regulates whether toner is permitted to enter entrance port 208 on developer unit 202. Specifically, as toner cartridge 100 is installed in image forming device 22 and mated with developer unit 202, projection 176 contacts and opens shutter 209. When toner cartridge 100 is separated from developer unit 202 and removed from image forming device 22, projection 176 disengages from and closes shutter 209. In the example embodiment illustrated, projection 176 includes a forward projecting portion 177 that extends away from front wall 114 and a knob 178 that extends sideways from the front of forward projecting portion 177.

With reference back to FIG. 2, when toner cartridge 100 is installed in image forming device 22, its various interface features must align with corresponding interface features on imaging unit 200 and image forming device 22. In its final position in image forming device 22, toner cartridge 100 is positioned above frame 206 of imaging unit 200 with exit port 152 (FIG. 3) aligned and mated with entrance port 208 on developer unit 202. In its final position, toner cartridge 100 does not apply a loading force on developer unit 202. Exit port 152 and entrance port 208 must be precisely aligned in order to prevent toner leakage between toner cartridge 100 and developer unit 202. Further, main interface gear 130 must align and mate with a corresponding drive gear in image forming device 22 that provides torque to main interface gear 130. If main interface gear 130 is misaligned, proper gear mesh may not be achieved, which may result in gear cogging. Electrical contacts for the processing circuitry 45 of toner cartridge 100 positioned within a connector 145 on end cap 118 must align and mate with corresponding electrical contacts in image forming device 22 in order to permit communication between toner cartridge 100 and image forming device 22. As shown, connector 145 includes a forward facing opening 145*a* for receiving the corresponding electrical contacts in image forming device 22. In the example embodiment illustrated, end cap 120 includes a tapered lead-in 145*b* that is aligned with opening 145*a* to guide the corresponding electrical contacts in image forming device 22 toward opening 145*a* as toner cartridge 100 is inserted. Further, slot 174 must be positioned to receive fin 210 as toner cartridge 100 is inserted into image forming device 22 and opening 175 must be positioned to receive the projection from the access door to image forming device 22 in order to unlock interlock 330. The positions of these various interface points must be tightly controlled in order to ensure proper operation of toner cartridge 100. As a result, toner cartridge 100 must be properly positioned from front-to-rear (direction "x" in FIG. 2), vertically (direction "y") and side-to-side or axially (direction "z"). The angle of insertion of toner cartridge ("Θ"), also referred to as yaw, must also be controlled to within an acceptable range in order to ensure proper positioning.

Figure 16:
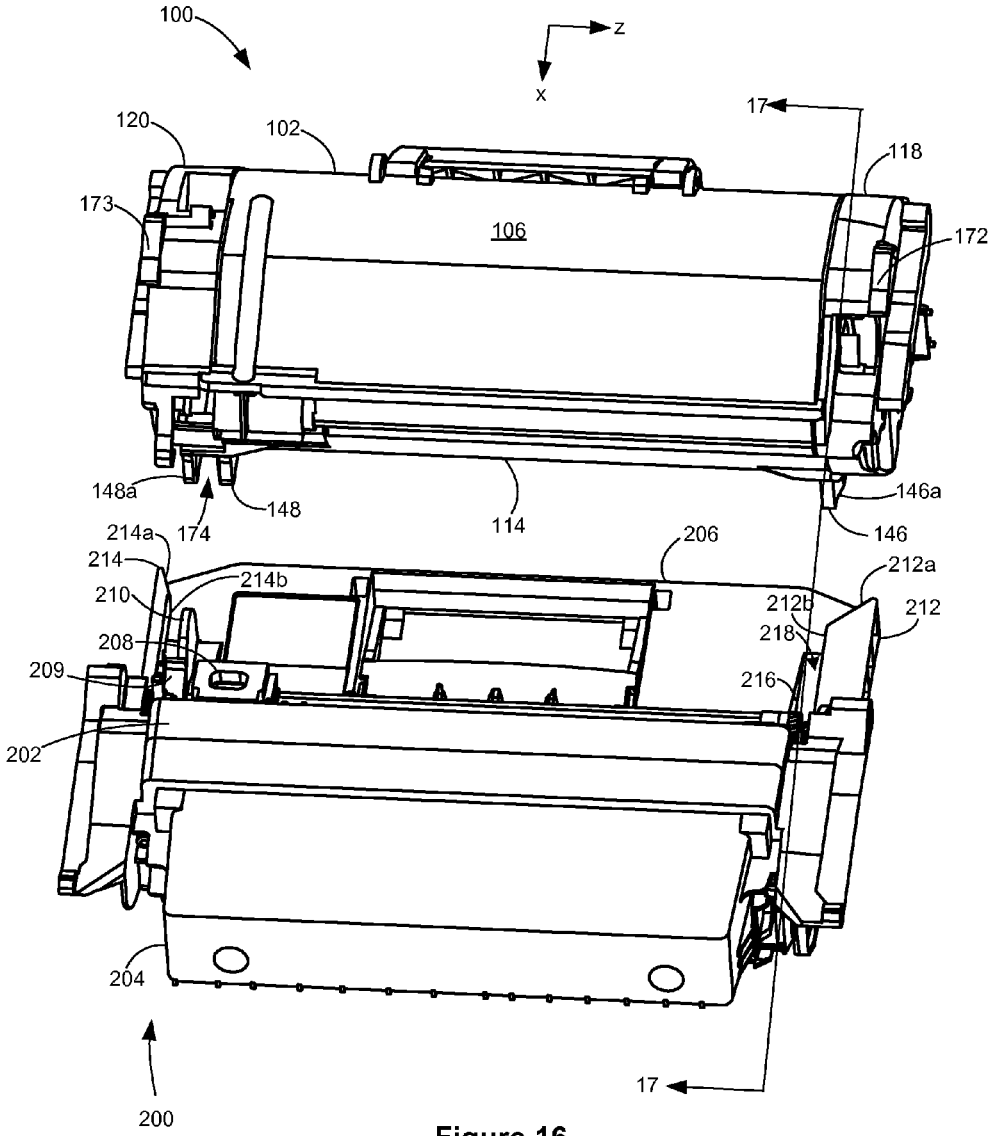
FIG. 16 is a top perspective view of the toner cartridge and imaging unit shown in FIG. 2.

With reference to FIGS. 2 and 16, toner cartridge 100 and imaging unit 200 include both coarse and fine axial positioning features. Toner cartridge 100 includes a pair of legs 146, 148 projecting downward from base 108. Legs 146, 148 are spaced along axial direction "z" from each other between end caps 118, 120. Legs 146, 148 extend along base 108 from a rear portion of toner cartridge toward front wall 114 parallel to direction of insertion "x." A front portion of leg 148 includes slot 174 therein. Frame 206 of imaging unit 200 includes a pair of vertical walls 212, 214 that correspond with legs 146, 148. Each vertical wall 212, 214 includes a beveled front surface 212*a*, 214*a* that is outwardly angled with respect to the direction of insertion "x" and faces toner cartridge 100 as toner cartridge 100 advances toward imaging unit 200. Each vertical wall 212, 214 also includes an inner surface 212*b*, 214*b* that is substantially parallel to the direction of insertion "x" of toner cartridge 100. Inner surfaces 212*b*, 214*b* are spaced inward from front surfaces 212*a*, 214*a*, respectively, along direction "x" toward developer unit 202. As toner cartridge 100 is inserted into image forming device 22, front surfaces 212*a*, 214*a* guide toner cartridge 100 toward developer unit 202 and limit the travel of toner cartridge 100 in the axial direction "z." If toner cartridge 100 is misaligned in the axial direction "z" during insertion, an outer surface 146*a*, 148*a* of one of its legs 146, 148 will contact the corresponding front surface 212*a* or 214*a* of vertical walls 212, 214. The angle of the front surface 212*a* or 214*a* will then urge toner cartridge 100 toward its proper axial alignment thereby providing coarse positional control as toner cartridge 100 advances toward developer unit 202.

Figure 17:
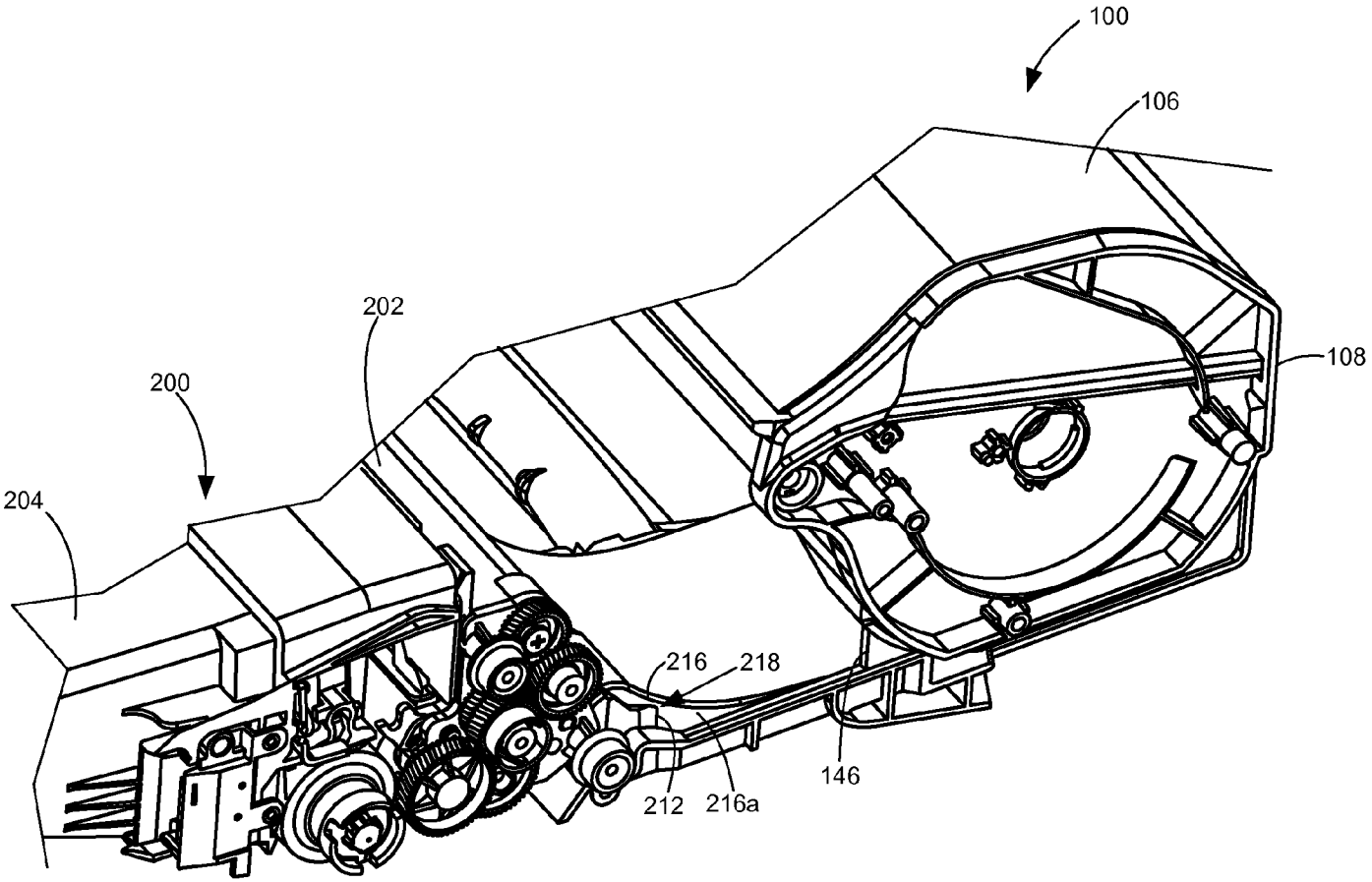
FIG. 17 is a cross-sectional view of the toner cartridge and imaging unit taken along line 17-17 in FIG. 16 with the toner cartridge advanced closer to the imaging unit.

As toner cartridge 100 is advanced further, outer surfaces 146*a*, 148*a* of legs 146, 148 are restrained between inner surfaces 212*b*, 214*b* of vertical walls 212, 214 further limiting the travel of toner cartridge 100 in the axial direction. In the example embodiment illustrated, the distance between outer surface 146*a* of leg 146 and outer surface 148*a* of leg 148 is between about 266 mm and about 269 mm. These coarse axial control features lead to fine axial control features in the form of a tightly controlled slot and tab interface shown in FIG. 17. FIG. 17 illustrates a cross-sectional view of toner cartridge 100 and imaging unit 200 taken along line 17-17 in FIG. 16 with toner cartridge 100 advanced closer to imaging unit 200. As shown in FIG. 17, a vertical wall 216 is spaced inward from vertical wall 212 along axial direction "z" forming a slot 218 therebetween. Specifically, slot 218 is formed between inner surface 212*b* of vertical wall 212 and an outer surface 216*a* of vertical wall 216. As toner cartridge 100 is advanced closer to developer unit 202, a front portion of leg 146 is received in slot 218 in frame 206 permitting slot 218 to tightly maintain the axial position of toner cartridge 100 as discussed in greater detail below.

Figure 4:
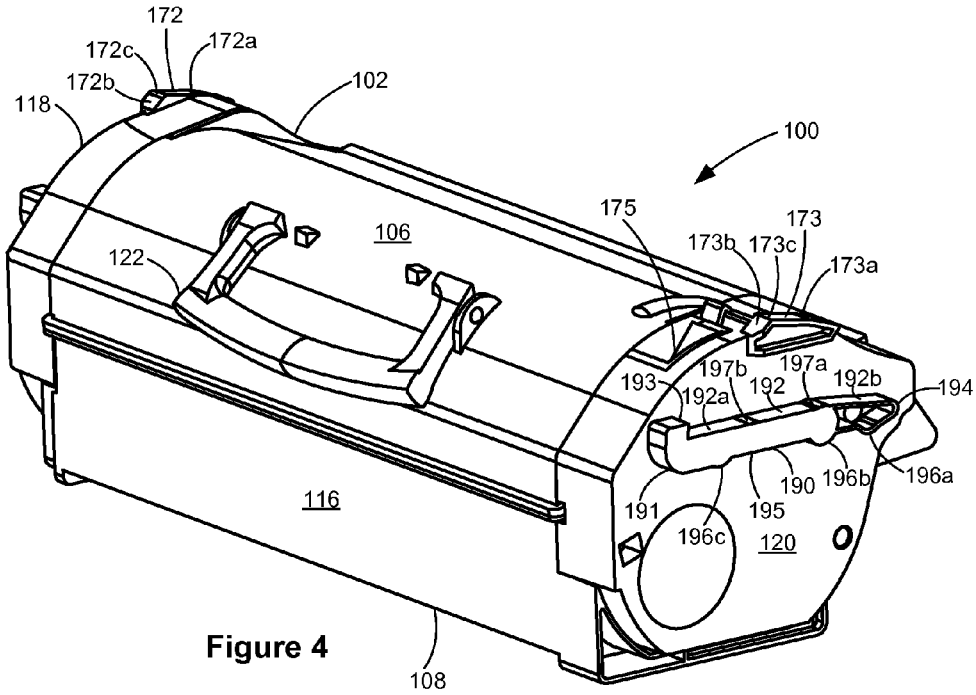
Figure 18:
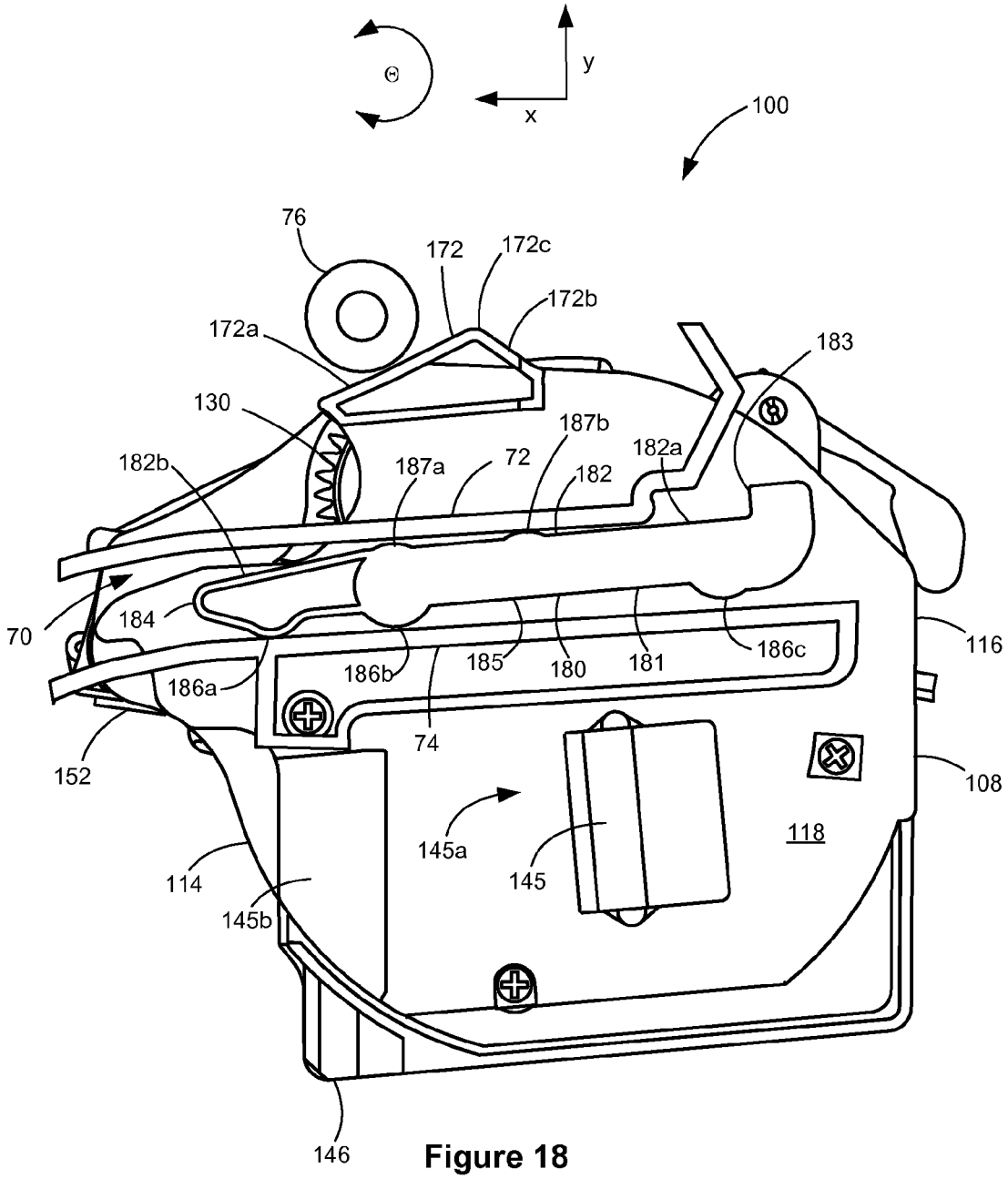
FIG. 18 is a side elevation view of the toner cartridge shown in FIG. 2 as it is loaded into an image forming device.
Figure 19:
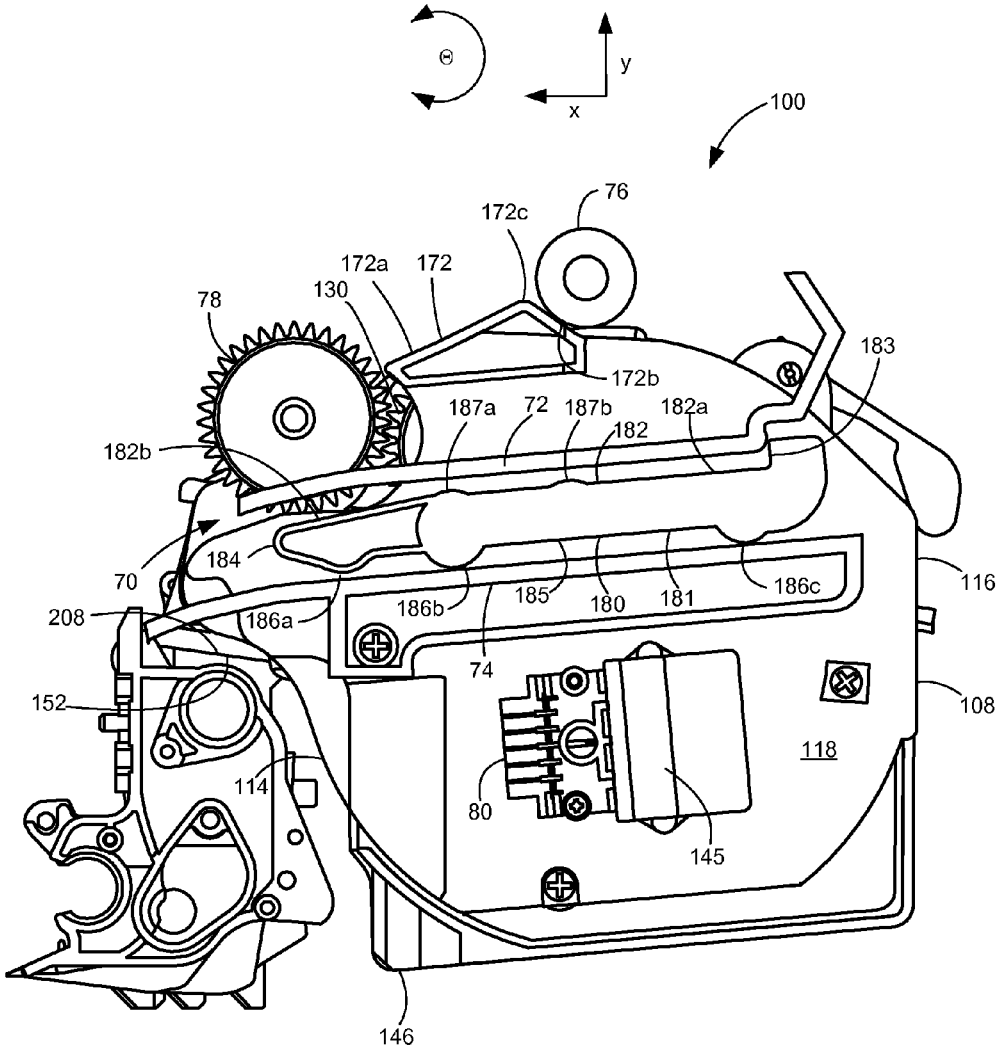
FIG. 19 is a side elevation view of the toner cartridge shown in FIG. 2 in its final position in the image forming device showing the engagement of various interface features.

With reference to FIGS. 18 and 19, the side surface of each end cap 118, 120 includes a wing guide 180, 190 (for end cap 120 and wing guide 190 see FIGS. 3 and 4). Each wing guide 180, 190 includes a generally elongated body 181, 191 that extends from a rear portion of its end cap 118, 120 toward a front portion thereof. Wing guides 180, 190 are substantially parallel to each other. As toner cartridge 100 is inserted into image forming device 22, wing guides 180, 190 each travel in a predetermined insertion path 70 defined by top and bottom guides 72, 74 running along an inner surface of image forming device 22. A top surface 182, 192 of each wing guide 180, 190 includes a substantially planar rear portion 182*a*, 192*a* that extends from a rear portion of its end cap 118, 120 toward a front portion thereof. Each top surface 182, 192 also includes a front portion 182*b*, 192*b* that is angled downward with respect to rear portion 182*a*, 192*a*, respectively. A stop 183, 193 extends vertically upward from each top surface 182, 192, respectively, that limits the forward travel of toner cartridge 100 as it is inserted into image forming device 22 as discussed in greater detail below. Each wing guide 180, 190 also includes a tapered nose 184, 194, respectively, forming a front tip thereof. In the example embodiment illustrated, a bottom surface 185, 195 of each respective wing guide 180, 190 includes three rounded projections 186*a*, 186*b*, 186*c* and 196*a*, 196*b*, 196*c* that define contact points with bottom guide 74 of image forming device 22. Wing guides 180, 190 are sometimes referred to as "dog bone" shaped because of the shape formed by bodies 181, 191 combined with rounded projections 186*b*, 186*c* and 196*b*, 196*c*. Top surface 182, 192 of each respective wing guide 180, 190 includes a pair of rounded projections 187*a*, 187*b*, 197*a* and 197*b*.

Each end cap 118, 120 also includes an engagement surface 172, 173 projecting upwardly from a top portion of the respective end cap 118, 120. Each engagement surface 172, 173 includes an angled front surface 172*a*, 173*a* that faces imaging unit 200 during insertion and an angled rear surface 172*b*, 173*b* that faces away from imaging unit 200 during insertion.

With reference to FIG. 18, as toner cartridge 100 is first inserted into image forming device 22, a roller 76 in image forming device 22 that is biased into the insertion path of toner cartridge 100 contacts front surfaces 172*a*, 173*a* of engagement surfaces 172, 173. The force applied to toner cartridge 100 by roller 76 controls the entry of toner cartridge 100 and prevents it from advancing into image forming device 22 too quickly. Further, as toner cartridge 100 is first inserted into image forming device 22, the downwardly angled front portions 182*b*, 192*b* and tapered nose 184, 194 of wing guides 180, 190 provide the user with a relatively broad range of permissible angles of insertion Θ (or yaw). As toner cartridge 100 advances, the insertion angle is limited by projections 187*a*, 187*b*, 197*a*, 197*b* on top surfaces 182, 192 and front projections 186*a*, 196*a* on bottom surfaces 185, 195 as shown.

With reference to FIG. 19, as toner cartridge 100 is advanced to its final position, roller 76 passes over an apex 172*c*, 173*c* of each engagement surface 172, 173 until it contacts rear surfaces 172*b*, 173*b*. The force applied by roller 76 to rear surfaces 172*b*, 173*b* of toner cartridge 100 urges toner cartridge 100 to its final position in image forming device 22. As toner cartridge 100 advances, stops 183, 193 contact top guide 72 in image forming device 22 to prevent toner cartridge 100 from advancing further thereby controlling the front-to-rear horizontal positioning of toner cartridge 100 along direction "x." The vertical position of toner cartridge 100 along direction "y" is controlled by the contact between rounded projections 186*b*, 186*c*, 196*b*, 196*c* and bottom guides 74 in image forming device 22. Specifically, three of the four rounded projections 186*b*, 186*c*, 196*b*, 196*c* form datum points that define a plane that determines the vertical position of toner cartridge 100. For example, in the example embodiment shown, the radii of rounded projections 186*b*, 186*c* and 196*b* are the same while the radius of rounded projection 196*c* is slightly smaller. As a result, in this embodiment, rounded projections 186*b*, 186*c* and 196*b* control the vertical position of toner cartridge 100.

Accurate positioning of toner cartridge 100 permits proper alignment between the various interface features of toner cartridge 100 and the corresponding interface features on imaging unit 200 and image forming device 22. As shown, in its final position, exit port 152 of toner cartridge 100 is aligned and mated with entrance port 208 on developer unit 202. Main interface gear 130 is aligned and mated with a corresponding drive gear 78 in image forming device 22. Electrical contacts for the processing circuitry in connector 145 are aligned and mated with corresponding electrical contacts on a connector 80 in image forming device 22. The positional control features of toner cartridge 100 ensure that these interface points are tightly controlled in order to ensure proper operation of toner cartridge 100. During operation, the force applied by roller 76 on rear surfaces 172*b*, 173*b* of engagement surfaces 172, 173 holds toner cartridge 100 in position and prevents it from separating from entrance port 208, drive gear 78 or electrical contacts 80.

Figure 20A:
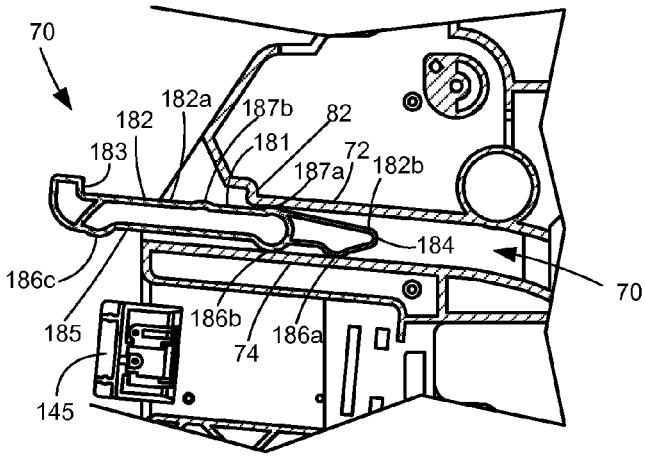
FIGS. 20A-C are sequential views of a first wing guide on the toner cartridge advancing in a corresponding insertion path in the image forming device according to one example embodiment.
Figure 20B:
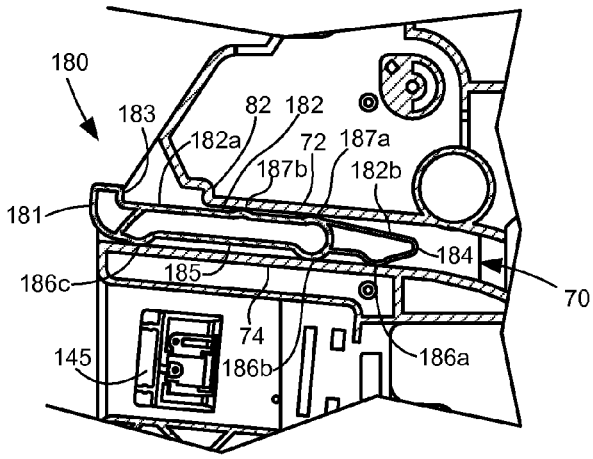
Figure 20C:
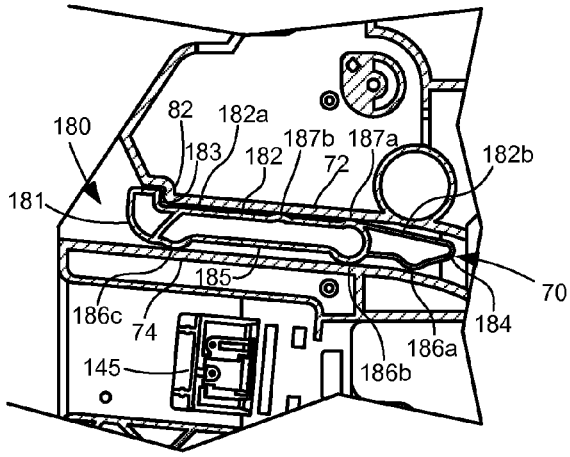
Figure 21A:
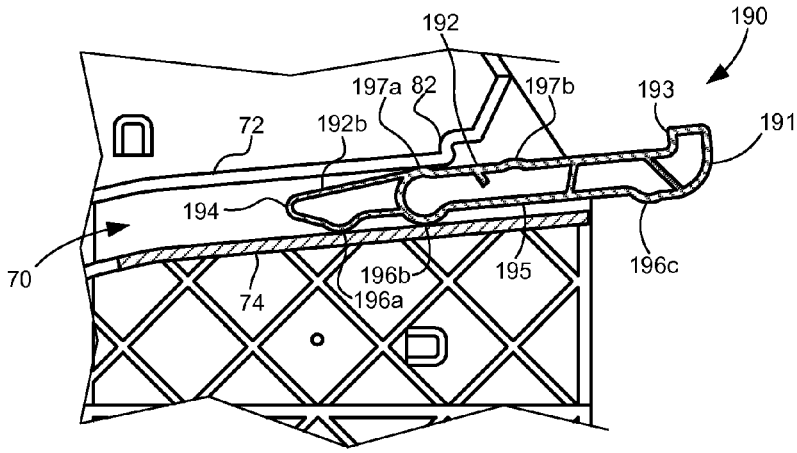
FIGS. 21A-C are sequential views of a second wing guide on the toner cartridge advancing in a corresponding insertion path in the image forming device according to one example embodiment.
Figure 21B:
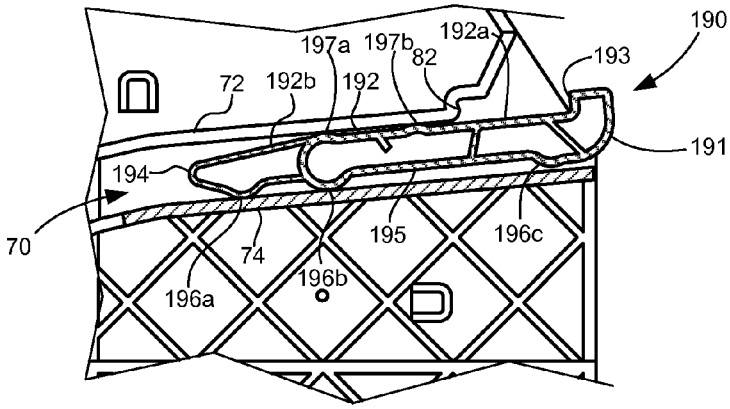
Figure 21C:
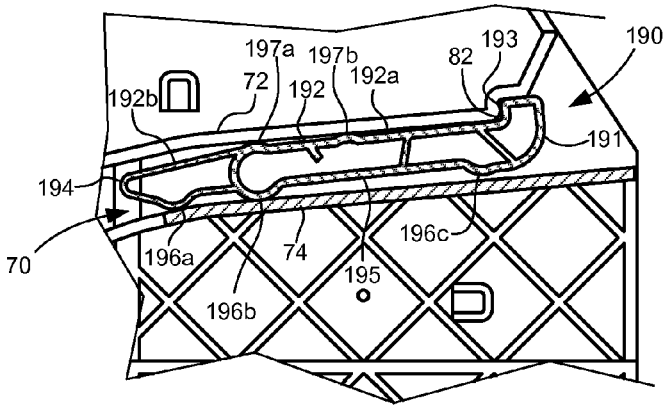
Figure 22A:
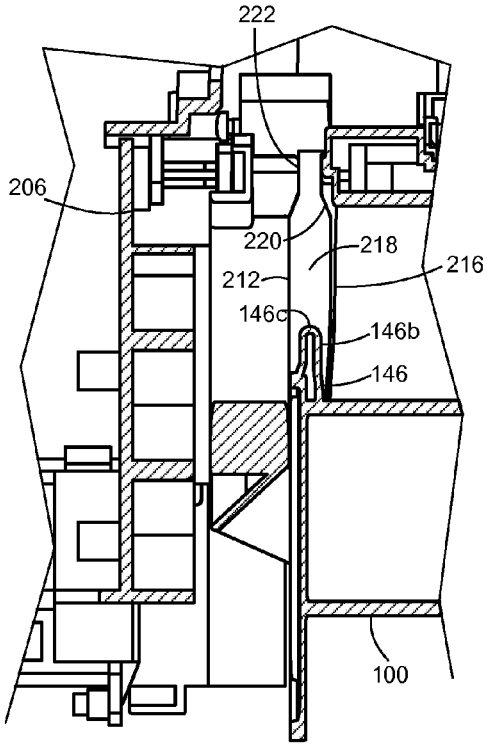
FIGS. 22A-C are sequential cross-sectional views of a leg of the toner cartridge taken along line 22-22 in FIG. 2 as the toner cartridge is inserted into the image forming device according to one example embodiment.
Figure 22B:
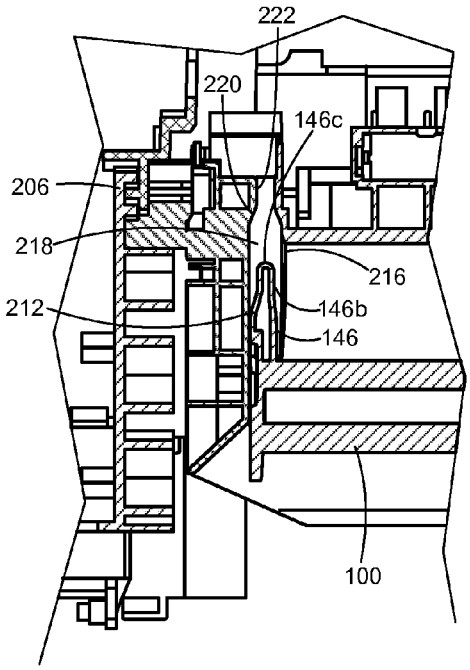
Figure 22C:
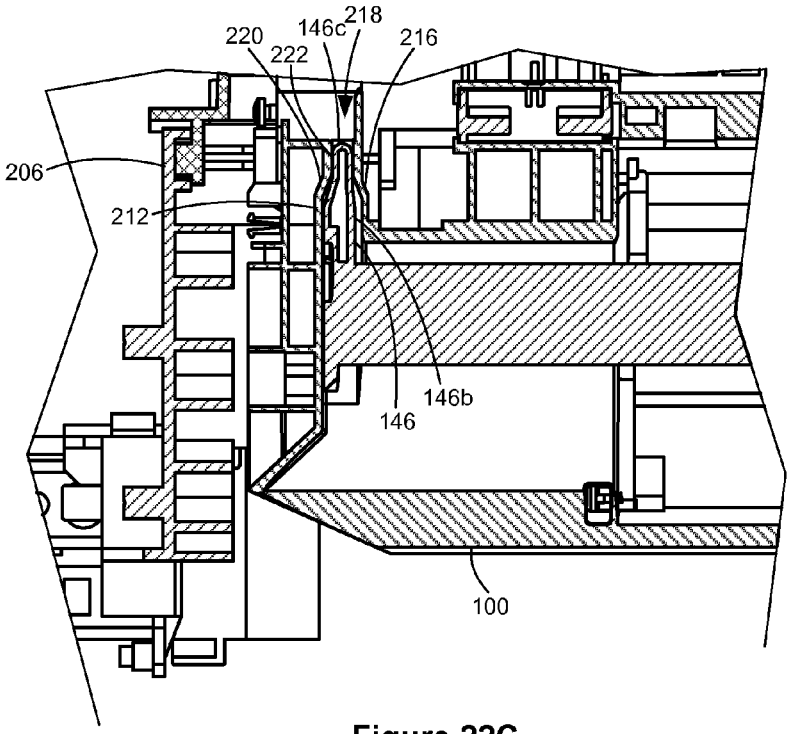

FIGS. 20A-C, 21A-C and 22A-C are sequential views illustrating the insertion of toner cartridge 100 into image forming device 22. FIGS. 20A-C and 21A-C show the positions of wing guides 180, 190, respectively, relative to insertion path 70 as toner cartridge 100 is inserted into image forming device 22. FIGS. 22A-C show cross-sectional views of leg 146 of toner cartridge 100 taken along line 22-22 in FIG. 2. FIGS. 20A, 21A and 22A show a first sequence view as toner cartridge 100 is initially inserted into image forming device 22. Specifically, FIGS. 20A and 21A show wing guides 180, 190, respectively, entering their respective insertion paths 70. FIG. 22A shows a front portion 180 of leg 146 entering slot 218 in frame 206. As illustrated, front portion 146*b* of leg 146 tapers in width forming a tab or nose 146*c* at a front tip thereof. In one embodiment, the width of nose 146*c* is between about 5 mm and about 9 mm. Slot 218 includes a corresponding tapered lead-in 220 to receive and guide front portion 146*b* of leg 146 into slot 218. Slot 218 also includes an inner slot portion 222 sized to tightly receive nose 146*c*. FIGS. 20B, 21B and 22B show a second sequence view as toner cartridge 100 is advanced further into image forming device 22. FIGS. 20B and 21B show wing guides 180, 190, respectively, advanced further along their respective insertion paths 70. FIG. 22B shows front portion 146*b* of leg 146 advanced further in slot 218. FIGS. 20C, 21C and 22C show a final sequence view with toner cartridge 100 fully inserted into image forming device 22 and mated with developer unit 202. FIGS. 20C and 21C show stops 183, 193 engaged with a corresponding lip or rounded stop 82 in image forming device 22. Stops 82 control the position of toner cartridge 100 in the direction of insertion and ensure that toner cartridge 100 is not over-inserted into image forming device 22. FIGS. 20C and 21C also show rounded projections 186*b*, 186*c* and 196*b*, positioned on bottom guide 74 and rounded projections 186*a*, 196*a* and 196*c* spaced from bottom guide 74. As discussed above, in this embodiment, rounded projections 186*b*, 186*c* and 196*b* define a plane that controls the vertical position of toner cartridge 100. FIG. 22C shows nose 146*c* tightly positioned in inner slot portion 222 to control the axial position of toner cartridge 100.

Figure 23:
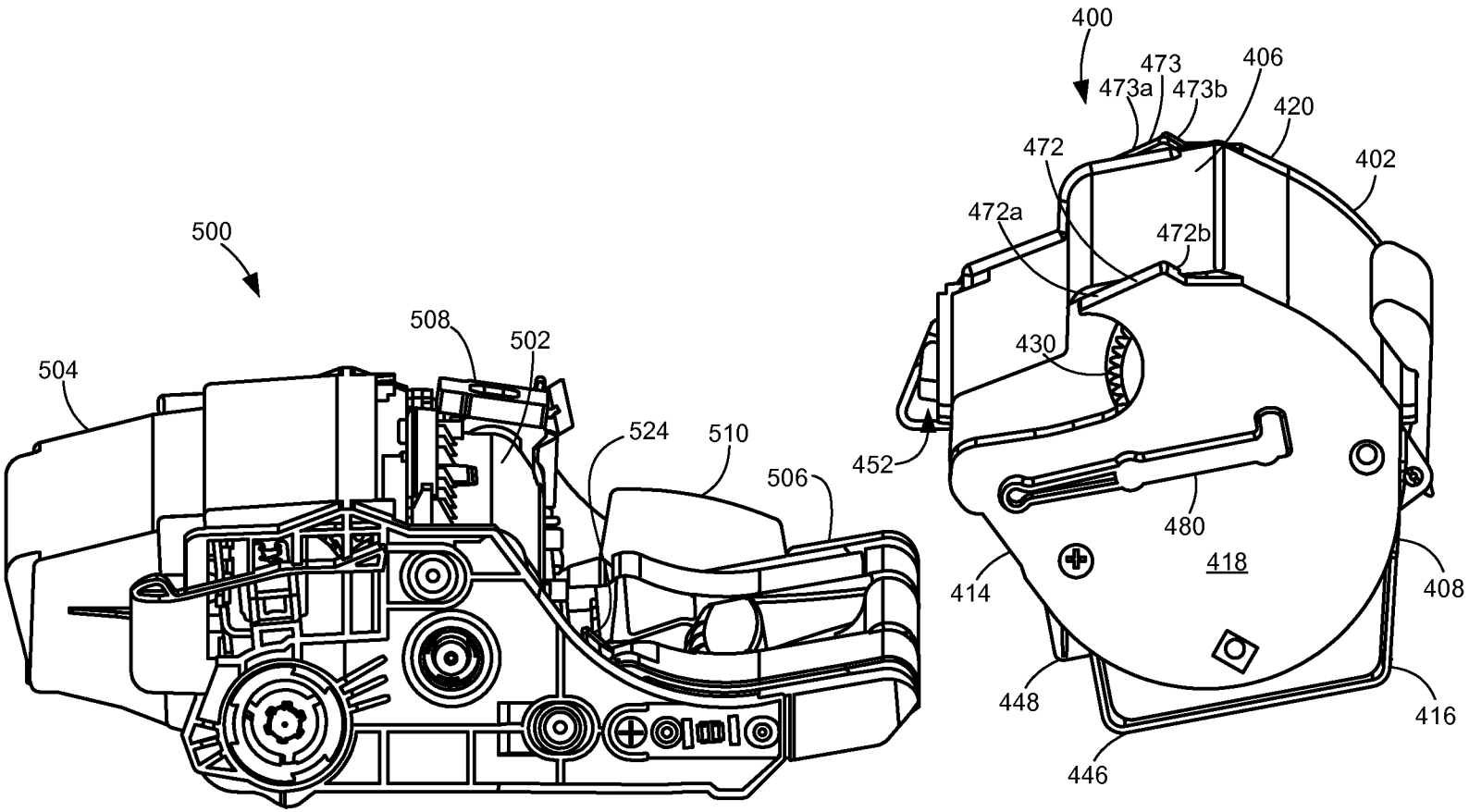
FIG. 23 is a perspective view of a toner cartridge and an imaging unit according to a second example embodiment.
Figure 24:
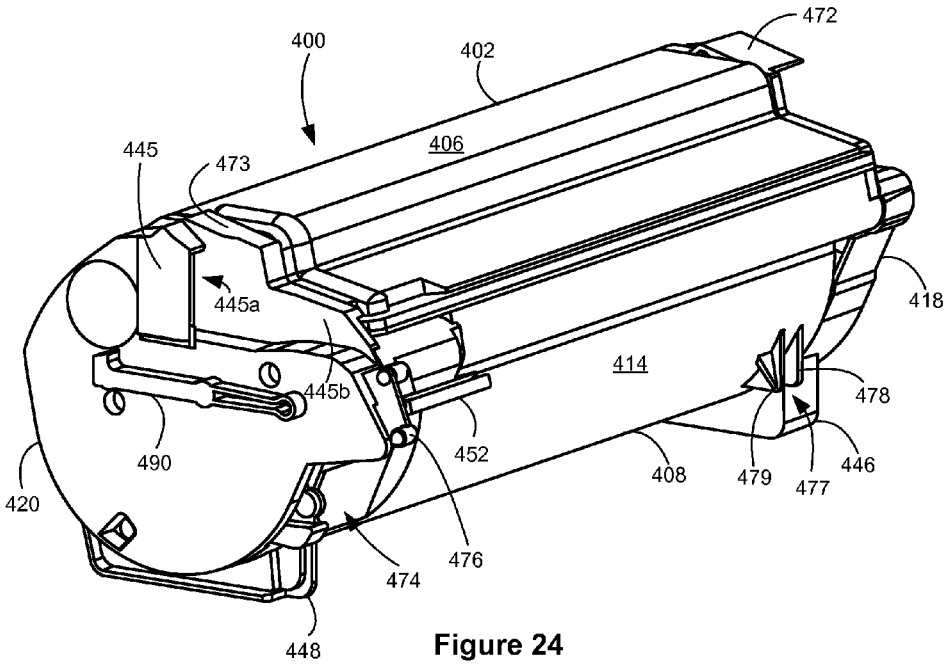
FIGS. 24 and 25 are additional perspective views of the toner cartridge shown in FIG. 23.
Figure 25:
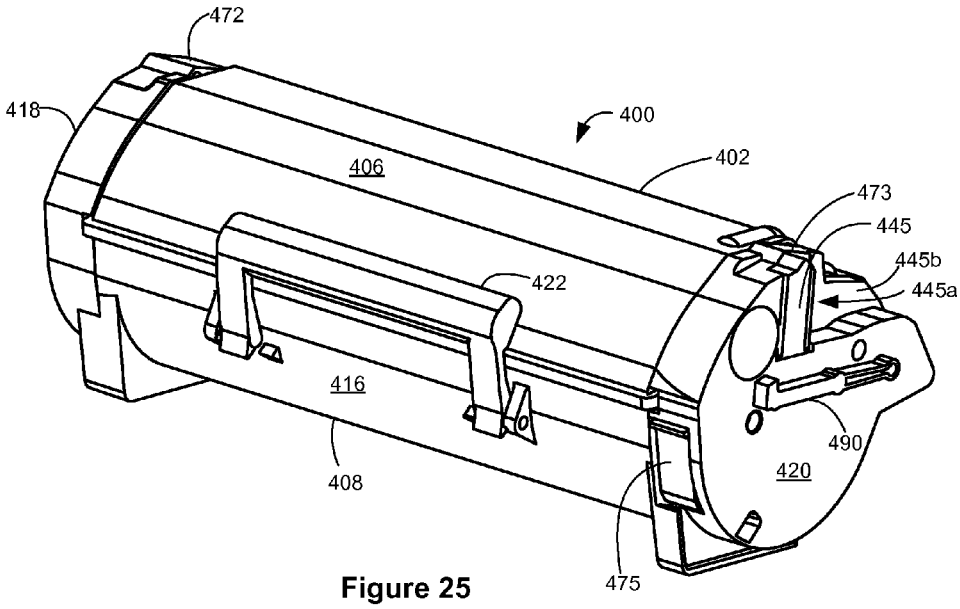

FIGS. 23-25 show a toner cartridge 400 and a corresponding imaging unit 500 according to a second example embodiment. Imaging unit 500 includes a developer unit 502 and a cleaner unit 504 mounted on a common frame 506. Developer unit 502 includes an entrance port 508 for receiving toner from toner cartridge 400. Frame 506 includes a projection 510 for actuating a shutter that regulates the flow of toner out of toner cartridge 400 similar to fin 210 discussed above. As discussed above, imaging unit 500 and toner cartridge 400 are each removably installed in image forming device 22. In its final position, toner cartridge 400 is in a mating relationship with developer unit 502 of imaging unit 500.

Toner cartridge 400 includes a housing 402 having a top or lid 406 mounted on a base 408. Housing 402 includes an enclosed reservoir therein for holding toner as discussed above. The internal components of the reservoir of toner cartridge 400 (e.g., the paddles, drive shaft, channel, and auger) are substantially the same as those discussed above with respect to toner cartridge 100. Base 408 includes first and second side walls connected to adjoining front and rear walls 414, 416. First and second end caps 418, 420 are mounted to the side walls (hidden by end caps 418, 420), respectively. A handle 422 may be provided on top 406 or base 408 of toner cartridge 400 as desired. A main interface gear 430 is exposed on front wall 414 between end cap 418 and its respective side wall. Main interface gear 430 engages with a drive system in image forming device 22 that provides torque to main interface gear 430. Various additional drive gears are housed within a space formed between end cap 418 and side wall 410 as discussed above with respect to toner cartridge 100. As discussed in greater detail below, various linkages are housed within a space formed between end cap 420 and side wall 412. An exit port 452 is disposed on front wall 414 in a downward facing orientation so that gravity will assist in exiting toner through exit port 452. Shutter assembly 150 discussed above may be used to regulate whether toner is permitted to exit toner cartridge 400 through exit port 452. Toner cartridge 400 also includes a connector 445 positioned on end cap 420 having electrical contacts for the processing circuitry of toner cartridge 400. Connector 445 includes a forward facing opening 445*a* for receiving the corresponding electrical contacts in imaging forming device 22. In the example embodiment illustrated, end cap 420 includes a tapered lead-in 445*b* that is aligned with opening 445*a* to guide the corresponding electrical contacts in image forming device 22 toward opening 445*a* as toner cartridge 400 is inserted. As shown in FIG. 24, toner cartridge 400 includes a rib or projection 476 projecting from front 414 of housing 402 near side wall 412 for actuating a shutter 509 (FIG. 27) that regulates whether toner is permitted to enter entrance port 508 on developer unit 502 as discussed above.

Figure 26:
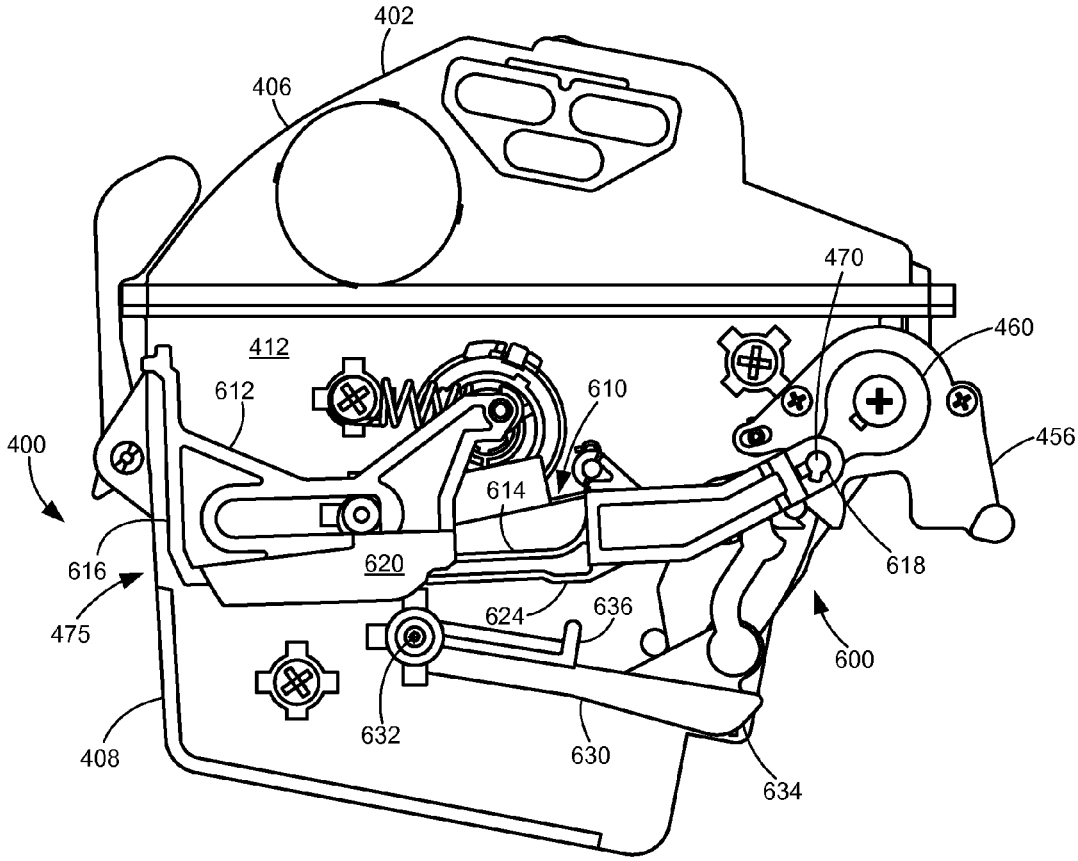
FIG. 26 is a side elevation view of the toner cartridge shown in FIG. 23 with an end cap removed to show a shutter lock mechanism in a locked position with a shutter closed according to a second example embodiment.

With reference to FIG. 26, toner cartridge 400 may include a shutter lock mechanism 600 according to another example embodiment. End cap 420 is removed in FIG. 26 to more clearly illustrate shutter lock mechanism 600. Shutter lock mechanism 600 includes a shutter linkage 610 that actuates a lever 460 to open and close the shutter as discussed above and an interlock 630 that prevents the shutter from opening unless toner cartridge 400 is installed within image forming device 22 and mated with imaging unit 500. In this embodiment, shutter linkage 610 includes an outer linkage 612 and an inner linkage 614. Outer linkage 612, in one form, is forked having an outer side wall 620 and an inner side wall (hidden behind outer side wall 620). Outer linkage 612 includes an engagement surface 616, such as a button-like area, that is exposed through a rearward facing opening 475 to an exterior portion of housing 402, such as a rear portion of end cap 420 next to base 408 as shown (see also FIG. 25). Inner linkage 614 is connected at one end to lever 460. In the example embodiment illustrated, inner linkage includes a channel 618 that receives a post 470 extending from lever 460; however, as discussed above, this connection may be established by any suitable means. Outer linkage 612 and inner linkage 614 are elongated members that overlap with one another. In the embodiment illustrated, inner linkage 614 is positioned in the fork between outer side wall 620 and the inner side wall of outer linkage 612; however, this configuration may be reversed as desired. Outer linkage 612 is biased by a suitable biasing member toward opening 475 where engagement surface 616 is exposed. Similarly, inner linkage 614 is biased by a biasing member away from lever 460 so that the shutter is biased toward the closed position. As discussed above with respect to outer linkage 312 and inner linkage 314 shown in FIGS. 10-15, an inner surface of outer linkage 612 includes a catch that engages a portion of inner linkage 614 when interlock 630 is unlocked but clears inner linkage 614 when interlock 630 is locked.

In this embodiment, interlock 630 is pivotally attached to side wall 412 at its axis of rotation 632. Interlock 630 extends along side wall 412 from its attachment point 632 toward front wall 414. Interlock 630 includes a curved or ramped engagement surface 634 that contacts an engagement feature, such as projection 510, on imaging unit 500 to permit the shutter to open. Interlock 630 also includes an upward extending post 636 that raises inner linkage 614 when interlock 630 is unlocked as discussed below. Interlock 630 is biased by one or more biasing members in the locked position shown in FIG. 26 to prevent the shutter from opening prior to installation of toner cartridge 400 in image forming device 22.

As discussed above, if engagement surface 616 is pressed while interlock 630 is in the locked position, outer linkage 612 travels past inner linkage 614 without depressing inner linkage 614. As a result, the shutter does not open. This allows the user to close the access door to image forming device 22 when imaging unit 500 is not present or press engagement surface 616 without opening the shutter.

When toner cartridge 400 is inserted into image forming device 22 and mated with imaging unit 500, an engagement feature on imaging unit 500, such as projection 510, contacts engagement surface 634 of interlock 630. The force from the engagement feature on interlock 630 overcomes the biasing force applied to interlock 630 and causes it to rotate in a counter-clockwise direction (as viewed in FIG. 26) to the unlocked position. The counter-clockwise rotation of interlock 630 causes post 636 to contact a bottom portion 624 of inner linkage 614 and raise inner linkage 614 into the path of the catch on outer linkage 612 as discussed above. A slot, such as forward facing slot 474 shown in FIG. 24, may be provided in base 408 and/or end cap 420 of toner cartridge 400 to receive the engagement feature 510. After toner cartridge 400 is inserted into image forming device 22, when an access door to image forming device 22 is closed, a plunger or other projection extending from an inner surface of the access door (or otherwise linked to the access door) presses engagement surface 616 overcoming the biasing force applied to outer linkage 612 and depressing both outer linkage 612 and inner linkage 614 causing lever 460 to rotate to open the shutter.

When toner cartridge 400 is removed from image forming device 22, this sequence is reversed. When the access door to image forming device 22 is opened, outer linkage 612 and inner linkage 614 retract to their biased positions, closing the shutter. As the user removes toner cartridge 400 from the device, engagement feature 510 disengages from engagement surface 634 causing interlock 630 to rotate in a clockwise direction (as viewed in FIG. 26). As interlock 630 rotates, inner linkage 614 lowers until it clears the path of the catch on outer linkage 612. As a result, the shutter will remain closed while toner cartridge 400 is removed from image forming device 22 even if engagement surface 616 is pressed.

Accordingly, it will be appreciated that a locking mechanism, such as locking mechanisms 300 and 600, having a shutter linkage and an interlock may be employed to ensure that a shutter, such as shutter 154, remains closed unless the toner cartridge is installed in the image forming device and mated with its corresponding imaging unit. Further, the use of an outer linkage that is capable of sliding past an inner linkage when the interlock is locked allows the user to close the access door to the image forming device when the imaging unit is not present without opening the shutter or damaging the image forming device or the toner cartridge. The user is also able to press the engagement surface of the shutter linkage, such as engagement surface 316 or 616, without opening the shutter.

With reference to FIGS. 23-25 and 27, toner cartridge 400 and imaging unit 500 include both coarse and fine axial positioning features. The coarse axial positioning features are similar to those discussed above with respect to toner cartridge 100 and imaging unit 200. Toner cartridge 400 includes a pair of legs 446, 448 extending downward from base 408. Frame 506 of imaging unit 500 includes a pair of vertical walls 512, 514 that form a guide 516 therebetween that receives leg 446 and a pair of vertical walls 518, 520 that form a guide 522 therebetween that receives leg 448 as toner cartridge 400 is inserted into image forming device 22. Each vertical wall 512, 514, 518, 520 includes a beveled front surface 512*a*, 514*a*, 518*a*, 520*a* that is outwardly angled with respect to the direction of insertion and faces toner cartridge 400 as toner cartridge 400 advances toward imaging unit 500. Front surfaces 512*a*, 514*a*, 518*a*, 520*a* guide toner cartridge 400 toward developer unit 502 as toner cartridge 400 is inserted into image forming device 22. Each vertical wall 512, 514, 518, 520 also includes an inner surface 512*b*, 514*b*, 518*b*, 520*b* that is substantially parallel to the direction of insertion of toner cartridge 400. Inner surfaces 512*b*, 514*b*, 518*b*, 520*b* restrain outer surfaces 446*a*, 448*a* of legs 446, 448 limiting the travel of toner cartridge 400 in the axial direction. In the example embodiment illustrated in FIGS. 23-25 and 27, the distance between outer surface 446*a* of leg 446 and outer surface 448*a* of leg 448 is between about 255 mm and about 258 mm.

Figure 27:
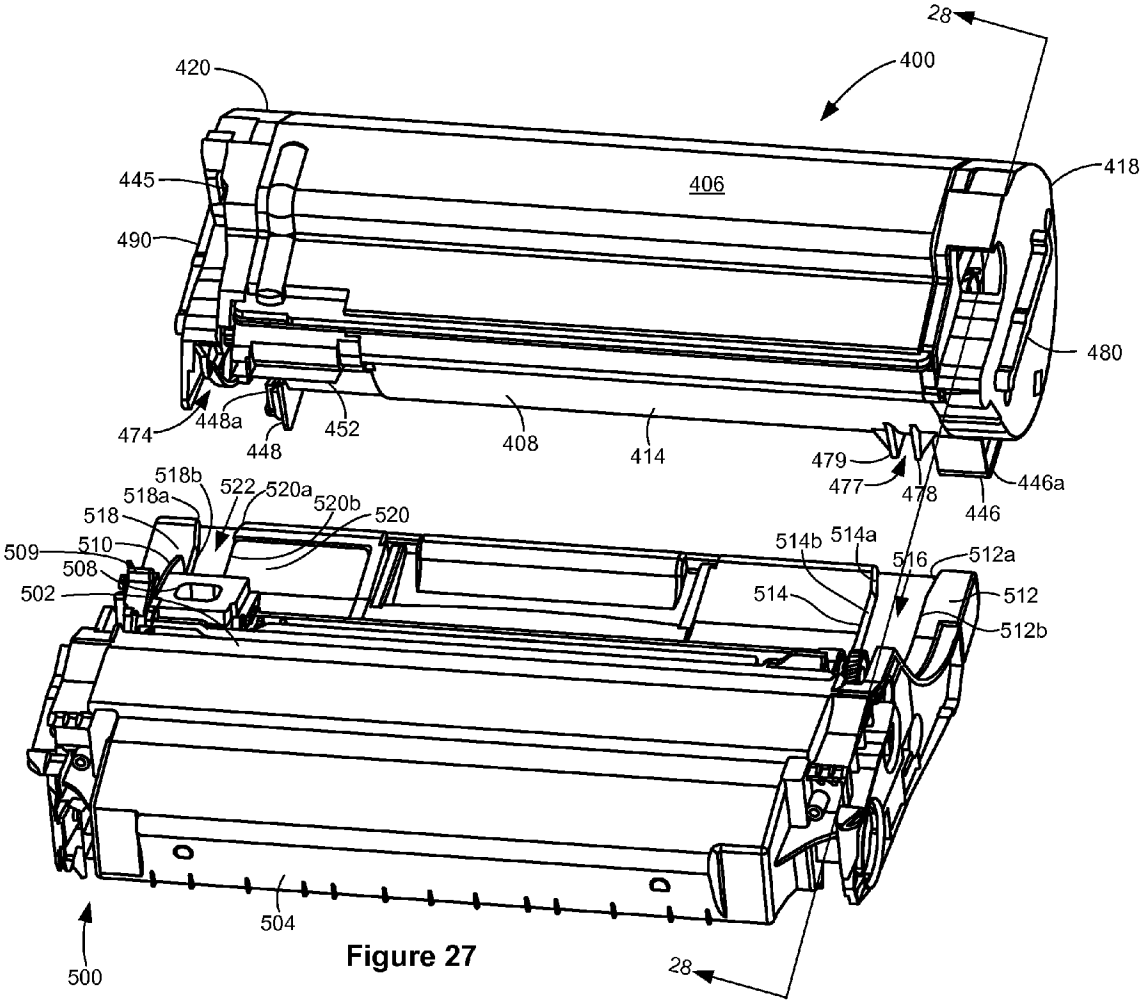
FIG. 27 is a top perspective view of the toner cartridge and imaging unit shown in FIG. 23.
Figure 28:
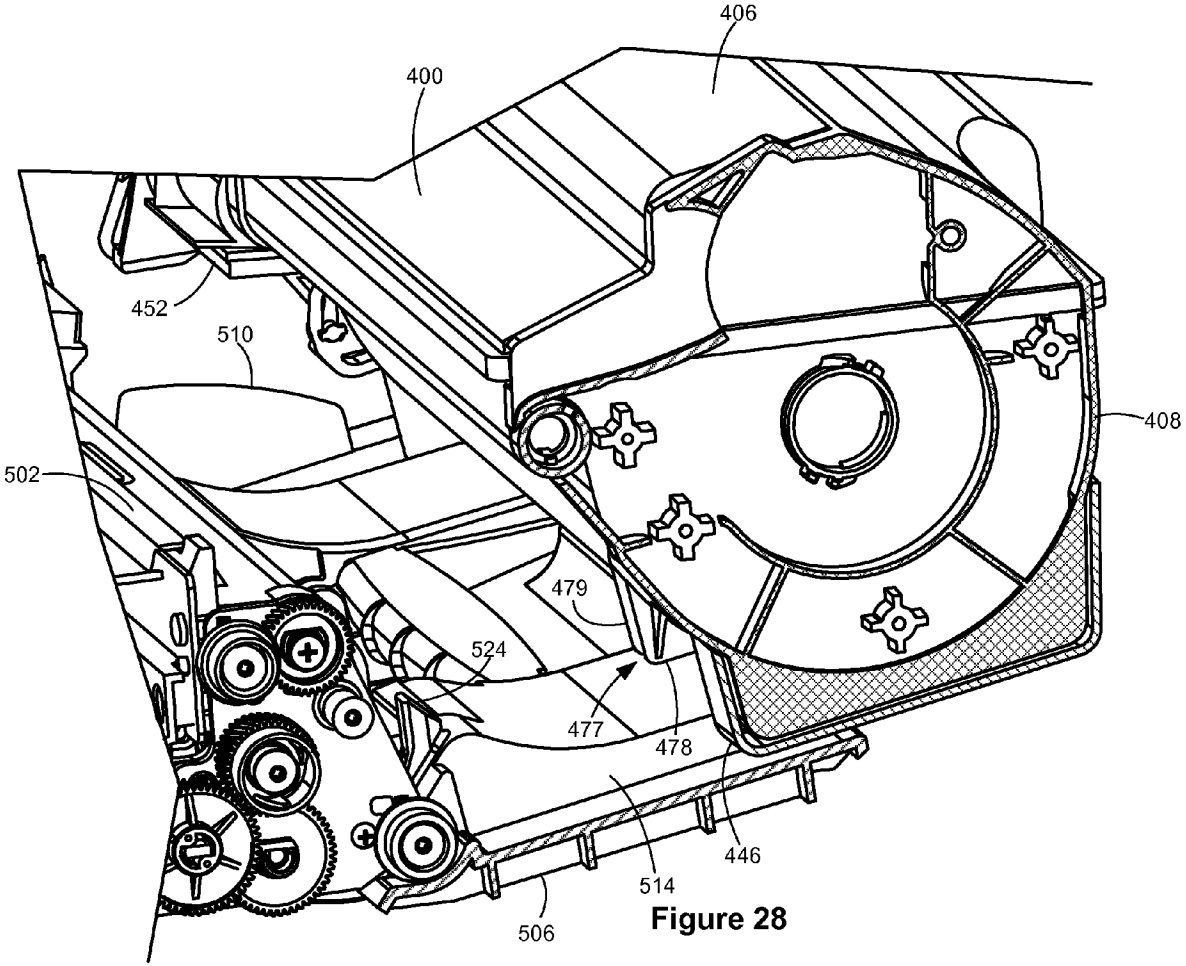
FIG. 28 is a cross-sectional view of the toner cartridge and imaging unit taken along line 28-28 in FIG. 27 with the toner cartridge advanced closer to the imaging unit.

FIG. 28 illustrates a cross-sectional view of toner cartridge 400 and imaging unit 500 taken along line 28-28 in FIG. 27. As shown in FIG. 28, a post 524 is spaced axially inward from guide 516 and extends upward from frame 506 of imaging unit 500. Toner cartridge 400 includes a slot 477 formed between a pair of substantially parallel walls 478, 479 that extend forward and downward from base 408. Slot 477 is spaced axially inward from leg 446. In the example embodiment illustrated in FIG. 28, the width of slot 477 is between about 6.3 mm and about 8.3 mm. As toner cartridge 400 is advanced toward developer unit 502, post 524 on imaging unit 500 is tightly received in slot 477 on toner cartridge 400 permitting slot 477 to precisely maintain the axial position of toner cartridge 400. As desired, post 524 and/or slot 477 may include a tapered lead-in section to facilitate engagement between the two.

With reference back to FIGS. 23-25 and 27, the side surface of each end cap 418, 420 includes a wing guide 480, 490. Each wing guide 480, 490 includes the "dog bone" structure described above with respect to wing guides 180, 190 of toner cartridge 100. As discussed above, wing guides 480, 490 control the front-to-rear horizontal positioning and vertical positioning of toner cartridge 400. Each end cap 418, 420 also includes an engagement surface 472, 473 projecting upwardly from a top portion of the respective end cap 418, 420. As discussed above, each engagement surface 472, 473 includes an angled front surface 472*a*, 473*a* that faces imaging unit 500 during insertion and an angled rear surface 472*b*, 473*b* that faces away from imaging unit 500 during insertion. During operation, rear surfaces 472*b*, 473*b* of engagement surfaces 472, 473 receive a hold-down force from a component in image forming device 22 to ensure that exit port 452, main interface gear 430, the electrical contacts in connector 445 and the engagement surfaces for shutter lock mechanism 600 maintain their engagement with imaging unit 500 or image forming device 22.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A toner cartridge for use in an image forming device, comprising:

a housing having a top, a bottom, a front, and a rear positioned between a first side and a second side of the housing, the housing defining a reservoir for containing toner therein;

an exit port in fluid communication with the reservoir and facing downward on the front of the housing near the first side;

a shutter positioned at the exit port that is movable between an open position to permit toner to pass out of the exit port and a closed position to prevent toner from passing out of the exit port;

a toner delivery system for transferring toner from the reservoir out of the exit port that includes a main interface gear for providing rotational power to the toner delivery system, a portion of the main interface gear being exposed on the front of the housing near the top of the second side and engagable with a corresponding drive gear in the image forming device;

a rearward facing opening exposed at the rear of the housing near the first side of the housing and extending from the rear of the housing toward the front of the housing for receiving a first engagement feature in the image forming device for opening and closing the shutter; and a forward facing slot exposed at the front of the housing near the first side of the housing and extending from the front of the housing toward the rear of the housing for receiving a second engagement feature in the image forming device for locking and unlocking the shutter.

2. The toner cartridge of claim 1, further comprising:

a first wing guide positioned on the first side of the housing and a second wing guide positioned on the second side of the housing substantially parallel to the first wing guide, each wing guide having a generally elongated body that extends along a front-to-rear dimension of the housing; and a pair of rounded projections extending from a bottom surface of one of the first wing guide and the second wing guide and a rounded projection extending from a bottom surface of the other of the first wing guide and the second wing guide that define contact points to control the vertical position of the toner cartridge in the image forming device.

3. The toner cartridge of claim 2, further comprising a first stop extending from the first wing guide and a second stop extending from the second wing guide to limit the forward travel of the toner cartridge in the image forming device.

4. The toner cartridge of claim 1, further comprising a first leg and a second leg each projecting from the bottom of the housing and extending along a front-to-rear dimension of the housing to limit the side-to-side travel of the toner cartridge during insertion into the image forming device.

5. The toner cartridge of claim 4, wherein a front portion of at least one of the first and second legs tapers forming a nose at a front tip thereof that is sized to engage a corresponding slot in the image forming device to more finely control the side-to-side travel of the toner cartridge in the image forming device.

6. The toner cartridge of claim 4, further comprising a slot on the front of the housing between the first and second legs that is sized to receive a corresponding projection in the image forming device to more finely control the side-to-side travel of the toner cartridge in the image forming device.

7. The toner cartridge of claim 1, further comprising a first engagement surface projecting to a topmost point of the housing near the first side of the housing and a second engagement surface projecting to the topmost point of the housing near the second side of the housing for receiving a hold down force from the image forming device, each of the first and second engagement surfaces including an angled front surface that faces toward the front of the housing and an angled rear surface that faces toward the rear of the housing.

8. The toner cartridge of claim 1, further comprising:

a linkage operatively connected to the shutter to open the shutter upon being actuated by the first engagement feature in the image forming device; and an interlock operatively engaged with the linkage and biased toward a locked position preventing the linkage from opening the shutter, the interlock being movable to an unlocked position upon being actuated by the second engagement feature in the image forming device that permits the linkage to open the shutter.

9. The toner cartridge of claim 8, wherein the linkage includes a first linkage member positioned to receive the first engagement feature and a second linkage member connected to the shutter, wherein in the locked position the interlock prevents the second linkage member from opening the shutter but permits the first linkage member to move relative to the second linkage member and in the unlocked position the interlock permits the second linkage member to open the shutter when the first linkage member is actuated by the first engagement feature.

10. The toner cartridge of claim 1, further comprising a connector on one of the first side and the second side of the housing having electrical contacts for processing circuitry of the toner cartridge, the connector having a forward facing opening for receiving corresponding electrical contacts in the image forming device, the one of the first side and the second side of the housing having a tapered lead-in aligned with the forward facing opening.

11. The toner cartridge of claim 1, wherein the toner delivery system includes:

an auger for delivering toner to the shutter that is rotatably mounted within the housing in a channel that extends along the front of the housing, the channel including a portion that is open to the reservoir; and a paddle rotatably mounted within the reservoir for delivering toner to the auger, the paddle having a rotational axis that is positioned below a rotational axis of the auger.

12. The toner cartridge of claim 1, further comprising a projection extending forward from the housing further forward than a frontmost portion of the exit port and spaced from the exit port toward the first side of the housing, a front of the projection being unobstructed for engaging a developer unit when the toner cartridge is inserted into the image forming device.

13. A toner cartridge for use in an image forming device, comprising:

a housing having a top, a bottom, a front, and a rear positioned between a first side and a second side of the housing, the housing defining a reservoir for containing toner therein, the housing having an elongated shape between the first side and the second side;

an exit port in fluid communication with the reservoir and facing downward on the front of the housing near the first side;

a toner delivery system for transferring toner from the reservoir out of the exit port that includes a main interface gear for providing rotational power to the toner delivery system, a portion of the main interface gear being exposed on the front of the housing near the top of the second side and engagable with a corresponding drive gear in the image forming device;

a rearward facing opening exposed at the rear of the housing near the first side of the housing and extending from the rear of the housing toward the front of the housing for receiving a first engagement feature in the image forming device; and a forward facing opening exposed at the front of the housing near the first side of the housing and extending from the front of the housing toward the rear of the housing for receiving a second engagement feature in the image forming device.

14. The toner cartridge of claim 13, further comprising:

a first wing guide positioned on the first side of the housing and a second wing guide positioned on the second side of the housing substantially parallel to the first wing guide, each wing guide having a generally elongated body that extends along a front-to-rear dimension of the housing; and a pair of rounded projections extending from a bottom surface of one of the first wing guide and the second wing guide and a rounded projection extending from a bottom surface of the other of the first wing guide and the second wing guide that define contact points to control the vertical position of the toner cartridge in the image forming device.

15. The toner cartridge of claim 14, further comprising a first stop extending from the first wing guide and a second stop extending from the second wing guide to limit the forward travel of the toner cartridge in the image forming device.

16. The toner cartridge of claim 13, further comprising a first leg and a second leg each projecting from the bottom of the housing and extending along a front-to-rear dimension of the housing to limit the side-to-side travel of the toner cartridge during insertion into the image forming device.

17. The toner cartridge of claim 16, wherein a front portion of at least one of the first and second legs tapers forming a nose at a front tip thereof that is sized to engage a corresponding slot in the image forming device to more finely control the side-to-side travel of the toner cartridge in the image forming device.

18. The toner cartridge of claim 16, further comprising a slot on the front of the housing between the first and second legs that is sized to receive a corresponding projection in the image forming device to more finely control the side-to-side travel of the toner cartridge in the image forming device.

19. The toner cartridge of claim 13, further comprising a first engagement surface projecting to a topmost point of the housing near the first side of the housing and a second engagement surface projecting to the topmost point of the housing near the second side of the housing for receiving a hold down force from the image forming device, each of the first and second engagement surfaces including an angled front surface that faces toward the front of the housing and an angled rear surface that faces toward the rear of the housing.

20. The toner cartridge of claim 13, further comprising a connector on one of the first side and the second side of the housing having electrical contacts for processing circuitry of the toner cartridge, the connector having a forward facing opening for receiving corresponding electrical contacts in the image forming device, the one of the first side and the second side of the housing having a tapered lead-in aligned with the forward facing opening.

21. The toner cartridge of claim 13, wherein the toner delivery system includes:

an auger for delivering toner to the exit port that is rotatably mounted within the housing in a channel that extends along the front of the housing, the channel including a portion that is open to the reservoir; and a paddle rotatably mounted within the reservoir for delivering toner to the auger, the paddle having a rotational axis that is positioned below a rotational axis of the auger.

22. The toner cartridge of claim 13, further comprising a projection extending forward from the housing further forward than a frontmost portion of the exit port and spaced from the exit port toward the first side of the housing, a front of the projection being unobstructed for engaging a developer unit when the toner cartridge is inserted into the image forming device.

23. The toner cartridge of claim 12, further comprising a knob that extends from the front of the projection away from the exit port toward the first side, a front of the knob being unobstructed for engaging the developer unit when the toner cartridge is inserted into the image forming device.

24. The toner cartridge of claim 22, further comprising a knob that extends from the front of the projection away from the exit port toward the first side, a front of the knob being unobstructed for engaging the developer unit when the toner cartridge is inserted into the image forming device.

25. The toner cartridge of claim 1, wherein the rearward facing opening and the forward facing slot are aligned with each other in a side-to-side dimension of the housing.

26. The toner cartridge of claim 13, wherein the rearward facing opening and the forward facing opening are aligned with each other in a side-to-side dimension of the housing.

* * * * *